US010615018B2

(12) United States Patent
Steiner

(10) Patent No.: US 10,615,018 B2
(45) Date of Patent: Apr. 7, 2020

(54) COLLISION CELLS AND METHODS OF USING THEM

(71) Applicant: PERKINELMER HEALTH SCIENCES, INC., Waltham, MA (US)

(72) Inventor: Urs Steiner, Branford, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 16/146,737

(22) Filed: Sep. 28, 2018

(65) Prior Publication Data

US 2019/0189411 A1 Jun. 20, 2019

Related U.S. Application Data

(63) Continuation of application No. 15/155,032, filed on May 15, 2016, now Pat. No. 10,103,013, which is a continuation of application No. 14/292,920, filed on Jun. 1, 2014, now Pat. No. 9,368,334.

(60) Provisional application No. 61/830,592, filed on Jun. 3, 2013, provisional application No. 61/830,150, filed on Jun. 2, 2013.

(51) Int. Cl.
*H01J 49/00* (2006.01)
*H01J 49/06* (2006.01)

(52) U.S. Cl.
CPC ..... *H01J 49/005* (2013.01); *H01J 49/063* (2013.01); *H01J 49/067* (2013.01); *H01J 49/068* (2013.01)

(58) Field of Classification Search
CPC ..... H01J 49/34; H01J 49/40; H01J 49/063; H01J 49/421; H01J 2237/0535; Y10T 29/49117
See application file for complete search history.

(56) References Cited

U.S. PATENT DOCUMENTS

| | | | | |
|---|---|---|---|---|
| 6,417,511 | B1 * | 7/2002 | Russ, IV | H01J 49/063 250/292 |
| 2006/0108520 | A1 * | 5/2006 | Park | H01J 49/066 250/287 |
| 2010/0288919 | A1 * | 11/2010 | Sheehan | H01J 49/067 250/282 |
| 2013/0068942 | A1 * | 3/2013 | Verenchikov | H01J 49/4245 250/282 |

* cited by examiner

*Primary Examiner* — Phillip A Johnston
*Assistant Examiner* — Hsien C Tsai
(74) *Attorney, Agent, or Firm* — Rhodes IP PLC; Christopher R Rhodes

(57) ABSTRACT

Certain embodiments described herein are directed to collision cells that comprise one or more integrated lenses. In some examples, a lens is coupled to two sections of a sectioned quadrature rod assembly, the lens comprising an aperture and a plurality of separate conductive elements disposed each one side of the lens, in which a respective disposed conductive element on one side of the lens is configured to electrically couple to a first, second, third, and fourth pole segments of the sectioned quadrature rod assembly.

20 Claims, 24 Drawing Sheets

COLLISION CELLS AND METHODS OF USING THEM

PRIORITY APPLICATIONS

This application is related to, and claims priority to, each of U.S. Provisional Application No. 61/830,150 filed on Jun. 2, 2013 and U.S. Provisional Application No. 61/830,592 filed on Jun. 3, 2013, the entire disclosure of each of which is hereby incorporated herein by reference for all purposes.

TECHNOLOGICAL FIELD

This application is related to mass spectrometry devices and methods of using them. More particularly, certain embodiments described herein are directed to collision cells for use in a mass spectrometer or other devices that receive ions.

BACKGROUND

Mass spectrometry separates species based on differences in the mass-to-charge (m/z) ratios of the ions.

SUMMARY

Certain features, aspects and embodiments described herein are directed to devices, systems and methods that include a collision cell and other similar components fluidically and/or electrically coupled to the collision cell. While certain configurations, geometries and arrangements are described herein to facilitate a better understanding of the technology, the described configurations are merely representative of the many different configurations that may be implemented.

In one aspect, an ion collision cell comprising a sectioned quadrature rod assembly configured to provide a collision region between an upstream region and a downstream region, the sectioned quadrature rod assembly comprising first, second, third, and fourth pole segments in each section of the quadrature rod assembly, and a lens coupled to two sections of the sectioned quadrature rod assembly, the lens comprising an aperture and a plurality of separate conductive elements disposed on each side of the lens, in which a respective disposed conductive element on at least one side of the lens is configured to electrically couple to the first, second, third, and fourth pole segments of the sectioned quadrature rod assembly is provided.

In certain embodiments, the cell comprises a gas port fluidically coupled to the upstream region for introducing a gas into the assembled sections. In other embodiments, the pole segments are curved. In some instances, the sectioned quadrature rod assembly is curved through about 180 degrees when the sections are coupled to the lens. In other configurations, the separate conductive elements disposed on the lens are components of a printed circuit board. In certain embodiments, the printed circuit board is a 2-layer printed circuit board. In additional embodiments, the lens is operative as a gas restrictor. In some examples, the lens is positioned in the upstream region of the ion collision cell. In further examples, the downstream region comprises a gas port configured to introduce a cooling gas into the downstream region. In other examples, the cell may comprise an additional lens coupled to two segments of the sectioned quadrature rod assembly, the additional lens comprising an aperture and a plurality of separate conductive elements disposed on each side of the additional lens, in which a respective disposed conductive element on each side of the additional lens is configured to electrically couple to the first, second, third, and fourth pole segments of the sectioned quadrature rod assembly. In some embodiments, the additional lens is positioned in the downstream region of the ion collision cell. In other embodiments, the cell may comprise a third lens, in which the third lens comprises a central conductive element and a terminal connector electrically coupled to the central conductive element through a body of the third lens. In certain embodiments, the third lens is positioned downstream from the additional lens. In other examples, the cell may comprise a fourth lens, in which the fourth lens comprises a central conductive element and a terminal connector electrically coupled to the central conductive element through a body of the fourth lens. In certain examples, the fourth lens is positioned downstream from the third lens. In some examples, the cell may comprise a first exit segment positioned between the additional lens and the third lens, a second segment positioned between the third lens and the fourth lens and a third exit segment coupled to the fourth lens. In certain embodiments, at least one of the exit segments is configured to receive a cooling gas. In other embodiments, the third lens and the fourth lens are configured to push or pull ions through the collision cell. In further embodiments, the third lens and the fourth lens are electrically coupled to a power source. In some examples, the third lens and the fourth lens each comprises a 4-layered printed circuit board.

In an additional aspect, an ion collision cell comprising a first region and a second region, in which each of the first region and the second region comprises a first support plate comprising first and second pole segments, in which the first and second pole segments comprise pole surfaces arranged at about 90 degrees with respect to each other, and a second support plate comprising third and fourth pole segments, in which the third and fourth pole segments comprise pole surfaces arranged about 90 degrees with respect to each other, the second support plate configured to couple to the first support plate to position the first, second, third, and fourth pole segments in proximity and arrange the first, second, third and fourth pole surfaces in a generally square cross section is disclosed. In certain examples, the cell comprises a lens positioned between segments in one of the first region and the second region, in which the lens comprises an aperture and a plurality of separate conductive elements disposed on each side of the lens, in which a respective disposed conductive element on at least one side of the lens is configured to electrically couple to one of the first, second, third, and fourth pole segments.

In some embodiments, the cell comprises a gas port fluidically coupled to the first region for introducing a gas into the assembled sections. In other embodiments, the pole segments are curved. In further embodiments, the ion collision cell is curved through about 180 degrees when the regions are coupled to each other. In additional embodiments, the separate conductive elements disposed on the lens are components of a printed circuit board. In some instances, the printed circuit board is a 2-layer printed circuit board. In additional instances, the lens is operative as a gas restrictor. In other examples, the lens is positioned within an entrance segment of the first region of the ion collision cell. In some examples, the second region comprises a gas port configured to introduce a cooling gas into the second region. In other examples, the cell comprises an additional lens in the second region, the additional lens comprising an aperture and a plurality of separate conductive elements disposed on each side of the additional lens, in which a respective disposed conductive element on each side of the additional lens is configured to electrically couple to one of the first, second, third, and fourth pole segments. In some embodiments, the additional lens is positioned in an exit section of the second region. In certain embodiments, the cell comprises a third lens in the second region, in which the third lens comprises a central conductive element and a terminal connector electrically coupled to the central conductive element through a body of the third lens. In certain instances, the third lens is positioned downstream from the additional lens. In some configurations, the cell comprises a fourth lens in the second region, in which the fourth lens comprises a central conductive element and a terminal connector electrically coupled to the central conductive element through a body of the fourth lens. In certain examples, the fourth lens is positioned downstream from the third lens. In other examples, the cell comprises a first exit segment positioned between the additional lens and the third lens, a second exit segment positioned between the third lens and the fourth lens and a third exit segment coupled to the fourth lens. In some embodiments, at least one of the exit segments is configured to receive a cooling gas. In additional examples, the third lens and the fourth lens are configured to push or pull ions through the collision cell. In other examples, the third lens and the fourth lens are electrically coupled to a power source. In further embodiments, the third lens and the fourth lens each comprises a 4-layered printed circuit board.

In another aspect, a mass spectrometer comprising an ion source, an ion detector and at least one collision cell fluidically coupled to the ion source at an entrance section and fluidically coupled to the ion detector at an exit section is described. In some embodiments, the ion collision cell comprises a sectioned quadrature rod assembly configured to provide a collision section between the entrance section and the exit section, the sectioned quadrature rod assembly comprising first, second, third, and fourth pole segments in each section of the quadrature rod assembly, and a lens between segments of at least one of the entry section and the exit section, the lens comprising an aperture and a plurality of separate conductive elements disposed on each side of the lens, in which a respective disposed conductive element on at least one side of the lens is configured to electrically couple to one of the first, second, third, and fourth pole segments of the sectioned quadrature rod assembly.

In certain embodiments, the mass spectrometer comprises a gas port fluidically coupled to the entrance section for introducing a gas into the collision cell. In other embodiments, the pole segments are curved. In further embodiments, the sectioned quadrature rod assembly is curved through about 180 degrees when the entrance section, the exit section and the collision section are coupled to each other. In additional embodiments, the separate conductive elements disposed on the lens are components of a printed circuit board. In some examples, the printed circuit board is a 2-layer printed circuit board. In further examples, the lens is operative as a gas restrictor. In additional examples, the lens is positioned between segments of the entrance section of the ion collision cell. In some embodiments, the exit section comprises a gas port configured to introduce a cooling gas into the exit section. In additional embodiments, the mass spectrometer may comprise an additional lens between segments of at least one of the entrance section and the exit section of the sectioned quadrature rod assembly, the additional lens comprising an aperture and a plurality of separate conductive elements disposed on each side of the additional lens, in which a respective disposed conductive element on each side of the additional lens is configured to electrically couple to one of the first, second, third, and fourth pole segments of the sectioned quadrature rod assembly. In some examples, the additional lens is positioned between segments of the exit section of the ion collision cell. In some embodiments, the mass spectrometer comprises a third lens in the exit section, in which the third lens comprises a central conductive element and a terminal connector electrically coupled to the central conductive element through a body of the third lens. In other embodiments, the third lens is positioned downstream from the additional lens. In further embodiments, the mass spectrometer comprises a fourth lens in the exit section, in which the fourth lens comprises a central conductive element and a terminal connector electrically coupled to the central conductive element through a body of the fourth lens. In additional embodiments, the fourth lens is positioned downstream from the third lens. In other embodiments, the mass spectrometer comprises a first exit segment positioned between the additional lens and the third lens, a second exit segment positioned between the third lens and the fourth lens and a third exit segment coupled to the fourth lens. In some examples, at least one of the exit segments is configured to receive a cooling gas. In other examples, the third lens and the fourth lens are configured to push or pull ions through the collision cell. In further examples, the third lens and the fourth lens are electrically coupled to a power source. In some examples, the third lens and the fourth lens each comprises a 4-layered printed circuit board.

In an additional aspect, a mass spectrometer comprising an ion source, an ion detector; and at least one collision cell fluidically coupled to the ion source at an entrance section and fluidically coupled to the ion detector at an exit section, the ion collision cell comprising a first region and a second region, in which each of the first region and the second region comprises a first support plate comprising first and second pole segments, in which the first and second pole segments comprise pole surfaces arranged at about 90 degrees with respect to each other, and a second support plate comprising third and fourth pole segments, in which the third and fourth pole segments comprise pole surfaces arranged about 90 degrees with respect to each other, the second support plate configured to couple to the first support plate to position the first, second, third, and fourth pole segments in proximity and arrange the first, second, third and fourth pole surfaces in a generally square cross section, and a lens positioned between segments in one of the first region and the second region, in which the lens comprises an aperture and a plurality of separate conductive elements disposed on each side of the lens, in which a respective disposed conductive element on each at least one side of the lens is configured to electrically couple to one of the first, second, third, and fourth pole segments is provided.

In certain examples, the mass spectrometer comprises a gas port fluidically coupled to the first region for introducing a gas into the assembled sections. In other examples, the pole segments are curved. In some embodiments, the ion collision cell is curved through about 180 degrees when the entrance section, the collision section and the exit section are coupled to each other. In additional embodiments, the separate conductive elements disposed on the lens are components of a printed circuit board. In further embodiments, the printed circuit board is a 2-layer printed circuit board. In other embodiments, the lens is operative as a gas restrictor. In some examples, the lens is positioned within a segment of the entrance section of the ion collision cell. In additional examples, the exit section comprises a gas port configured to introduce a cooling gas into the second region. In some instances, the mass spectrometer comprises an additional lens between segments of at least one of the entrance section and the exit section, the additional lens comprising an aperture and a plurality of separate conductive elements disposed on each side of the additional lens, in which a respective disposed conductive element on each side of the additional lens is configured to electrically couple to one of the first, second, third, and fourth pole segments. In other embodiments, the additional lens is positioned in an exit section of the second region. In some embodiments, the mass spectrometer comprises a third lens in the exit section, in which the third lens comprises a central conductive element and a terminal connector electrically coupled to the central conductive element through a body of the third lens. In certain embodiments, the third lens is positioned downstream from the additional lens. In other embodiments, the mass spectrometer comprises a fourth lens in the exit section, in which the fourth lens comprises a central conductive element and a terminal connector electrically coupled to the central conductive element through a body of the fourth lens. In some instances, the fourth lens is positioned downstream from the third lens. In other embodiments, the exit section comprises a first exit segment positioned between the additional lens and the third lens, a second exit segment positioned between the third lens and the fourth lens and a third exit segment coupled to the fourth lens. In certain examples, at least one of the exit segments is configured to receive a cooling gas. In other examples, the third lens and the fourth lens are configured to push or pull ions through the collision cell. In some embodiments, the third lens and the fourth lens are electrically coupled to a power source. In other embodiments, the third lens and the fourth lens each comprises a 4-layered printed circuit board.

In another aspect, an entrance section of a collision cell comprising an entrance segment comprising an entrance configured to receive ions from an ion source, and a lens configured to couple to the entrance segment downstream of the entrance of the entrance segment, the lens comprising an aperture and a plurality of separate conductive elements disposed on each side of the lens, in which a respective disposed conductive element on at least one side of the lens is configured to electrically couple to one of first, second, third, and fourth pole segments of a sectioned quadrature rod assembly and a first disposed conductive elements on the other side of the lens is configured to couple to the entrance segment is provided.

In certain embodiments, the entrance section comprises an additional entrance segment configured to electrically couple to a second disposed conductive element on the other side of the lens. In other embodiments, the entrance section comprises a third entrance segment configured to electrically couple to a third disposed conductive element on the other side of the lens. In further embodiments, the entrance section comprises a fourth entrance segment configured to electrically couple to a fourth disposed conductive element on the other side of the lens. In some examples, the entrance segment comprises integral spring contacts to couple the entrance segment to one of the disposed conductive elements on the other side of the lens. In other embodiments, the entrance segment comprises an integral alignment feature to couple the entrance segment to a support plate. In some examples, the entrance section comprises a gas port fluidically coupled to the entrance segment. In further examples, the entrance section comprises an additional lens in the entrance section. In other examples, the entrance section comprises a second entrance segment between the lens and the additional lens. In some embodiments, a collision section configured to couple to the entrance section is provided.

In an additional aspect, an exit section of a collision cell comprising an exit segment comprising an exit configured to provide ions from the collision cell, and a lens configured to couple to the exit segment upstream of the exit of the exit segment, the lens comprising a central conductor and a terminal conductor electrically coupled to the central conductor through a body of the lens, the terminal conductor configured to couple to a power source to provide a current to the central conductor is described.

In certain embodiments, the exit section comprises an additional exit segment upstream of the lens. In other embodiments, the exit section comprises an additional lens configured to couple to the additional exit segment upstream of the additional exit segment, the additional lens comprising a central conductor and a terminal conductor electrically coupled to the central conductor through a body of the additional lens, the terminal conductor configured to couple to a power source to provide a current to the central conductor. In some instances, the exit section comprises a third exit segment upstream of the additional lens. In further instances, the exit section comprises a third lens upstream of the third exit segment, the third lens comprising an aperture and a plurality of separate conductive elements disposed on each side of the third lens, in which a respective disposed conductive element on at least one side of the lens is configured to electrically couple to one of first, second, third, and fourth pole segments of a sectioned quadrature rod assembly and a first disposed conductive element on the other side of the lens is configured to couple to the third exit segment. In other embodiments, the exit segment comprises an integral alignment feature to couple the exit segment to a support plate. In additional examples, the third exit segment comprises integral spring contacts to electrically couple the third exit segment to the third lens. In some examples, the exit section comprises a gas port fluidically coupled to the exit segment. In certain embodiments, each of the lens and the additional lens comprises spring contacts to electrically couple the terminal connector of the lenses to an electrical contact. In further embodiments, a collision section configured to couple to the exit section is provided.

In another aspect, an ion collision cell comprising an entrance section and a collision section, the entrance section comprising a sectioned quadrature rod assembly comprising first, second, third, and fourth pole segments in each section of the quadrature rod assembly, and a lens coupled to two entrance segment in the entrance section of the sectioned quadrature rod assembly, the lens comprising an aperture and a plurality of separate conductive elements disposed on each side of the lens, in which a respective disposed conductive element on at least one side of the lens is configured to electrically couple to the first, second, third, and fourth pole segments of the sectioned quadrature rod assembly is described.

In an additional aspect, an ion collision cell comprising an exit section and a collision section, the exit section comprising a sectioned quadrature rod assembly comprising first, second, third, and fourth pole segments in each section of the quadrature rod assembly, and a lens coupled to two exit segments in the exit section of the sectioned quadrature rod assembly, the lens comprising an aperture and a plurality of separate conductive elements disposed on each side of the lens, in which a respective disposed conductive element on each side of the lens is configured to electrically couple to the first, second, third, and fourth pole segments of the sectioned quadrature rod assembly is disclosed.

Additional features, aspect, examples and embodiments are described in more detail below.

BRIEF DESCRIPTION OF THE FIGURES

Certain embodiments of the devices and systems are described with reference to the accompanying figures in which.

It will be recognized by the person of ordinary skill in the art, given the benefit of this disclosure, that certain dimensions or features of the components of the systems may have been enlarged, distorted or shown in an otherwise unconventional or non-proportional manner to provide a more user friendly version of the figures. In addition, the exact length, width, geometry, aperture size, etc. of the lenses and collision cells described herein may vary.

DETAILED DESCRIPTION

Certain embodiments are described below with reference to singular and plural terms in order to provide a user friendly description of the technology disclosed herein. These terms are used for convenience purposes only and are not intended to limit the devices, methods and systems described herein. Certain examples are described herein with reference to the terms upstream and downstream. Unless otherwise specified, these terms refer generally to the direction of ion flow within the collision cell. For example, as ions enter the collision cell at an entrance end, they are then provided to a collision section coupled to the entrance end. The collision section would be considered downstream of the entrance end, and the entrance end would be considered upstream of the collision section.

Figure 1:
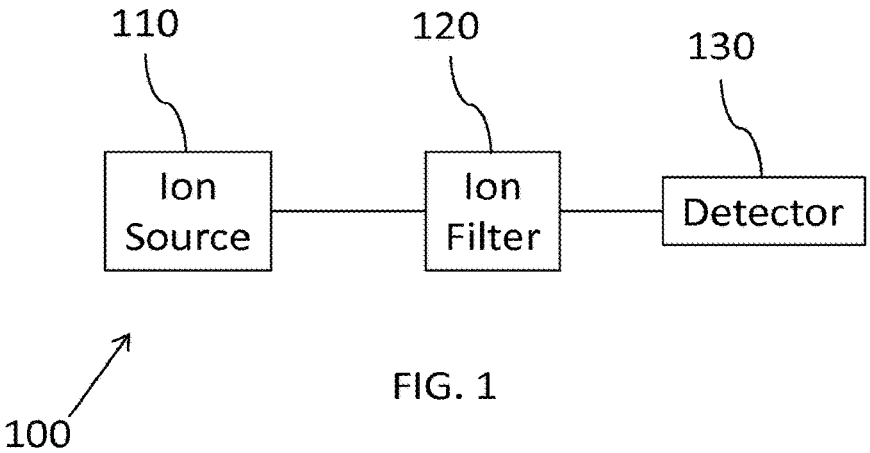
FIG. 1 is a block diagram of a mass spectrometer, in accordance with certain examples.

In certain configurations, the collision cells described herein may be used in a mass spectrometer. For example, the collision cell may be fluidically coupled to various other components of a mass spectrometer system. A block diagram of certain components of such a system is shown in FIG. 1. The system 100 comprises an ion source 110 fluidically coupled to an ion filter 120. The ion filter 120 is fluidically coupled to a detector 130. Chemical species are provided to the ion source 110 which is operative to ionize the species. The resulting ions are provided to the ion filter 120, where ions of a desired mass-to-charge (m/z) ratio can be selected. The selected ions are then provided to the detector 130 for detection. Various ion sources and detectors are described in more detail herein. In some instances, the ion filter may comprise one or more integral lenses that can be used to control the pressure and/or selection or transmission of ions. For example, a lens with a central aperture or orifice can be inserted in-line with poles or pole components of the filter. The size of the aperture can be selected to decrease the pressure in the system without any substantial reduction in ion transmission. The lens can be configured to permit a RF field to be sustained through the lens. One attribute of using the lenses described herein is gas flows can be decreased (compared to a filter with no lenses), e.g., a gas flow of 30%, 40% or 50% less can be used in the system. In some instances, the background pressure can be decreased 5× or even 10× or more by using one or more of the lenses described herein in an ion filter.

In certain examples, the ion filter 120 may comprise, or be operative as, a collision cell. For example, ions entering the collision cell may be collided with a gas or other species to fragment the ions or react the ions with another molecule. The introduced ions can be provided to a region within the collision cell for a selected period to permit fragmentation and/or reaction of the ions with a gas. The resulting products or fragments may then exit the cell and are provided to the detector. The collisional or reaction energy can be varied in many ways, for example, by varying the introduced ion's initial velocity, the size of the collision gas, the type of collision gas and the number of collisions encountered. The number of collisions can depend, at least in part, on the gas pressure and the reaction time. During the collision process, the charge of the introduced ion can remain on one of the produced fragments and the other produced fragments or species may be neutral. These neutral species can be provided to another mass filter, and produce non-specific signals, reducing the sensitivity of the mass spectrometer. If an introduced ion collides with a collision gas molecule, its flight path may be altered. In most instances, an ion focusing field, e.g., an RF field, is present in the collision cell to guide the ions through the collision cell and to a detector.

In certain configurations described herein, one or more lenses may be placed between sections of structures of the collision cell, or within particular segments of a section of the collision cell, to provide an ion focusing field. For example, a lens may be present between sections of the collision cell and may comprise a selected orifice or aperture shape, e.g., an aperture of defined geometry and/or size, to control or limit gas flow through the cell while permitting the ion fields to continue or be present in a desired shape or strength. Various embodiments described herein may include one, two, three, four or more lenses placed in the collision cell at selected sites and/or between selected sections. In some instances, the lenses may include conductive elements on their surfaces to permit electrical coupling with the ion guide sections to avoid disruption of the ion fields within the collision cell. Attributes of the systems comprising the collision cells described herein include, but are not limited to, the usage of lower volumes of collision-induced dissociation (CID) gas (or less collisionally activated dissociation gas if desired or when used) for a selected collision or reaction and the ability to use reduced pump speeds for a selected collision or reaction.

Figure 2A:
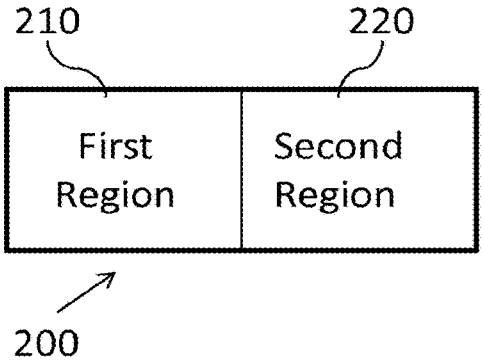
FIGS. 2A-2D are block diagrams of first and second regions of a collision cell and various lens arrangements in the collision cell, in accordance with certain examples.
Figure 2B:
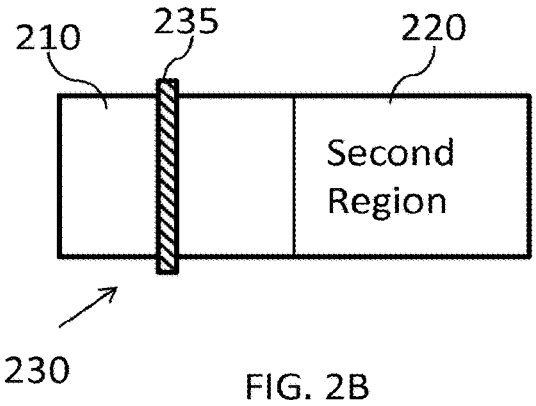
Figure 2C:
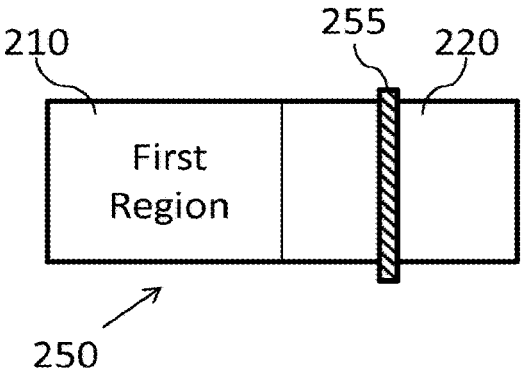
Figure 2D:
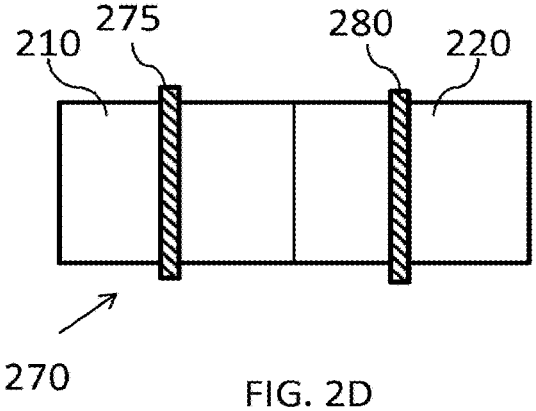

In certain embodiments, a block diagram of selected zones, regions or sections in a collision cell is shown in FIG. 2A. The collision cell 200 comprises a first region or section 210 and a second region or section 220. The first section or region 210 may be a pre-collision zone and is typically fluidically coupled to an ion source (not shown) such that species from the ion source may be provided to the cell 200 in a fluid stream, e.g., a gas stream, or as an ion beam. The second region or zone 220 is typically fluidically coupled to an ion detector (not shown) to provide the selected ions to the detector for detection. While the exact pressures in the cell 200 may vary, the first region 210 is typically at a different pressure than the second region 220. In particular, a collision gas or reactive species can be introduced into the second region 220 under pressure to collide or react with introduced ions. In embodiments of the cells described herein, the presence of lenses between segments of the first region 210 or segments of the second region 220, or both, can permit for better control of pressure in the second region 220 compared to a collision cell not including the lenses. The exact placement of the lenses described herein may vary and several configurations are shown in FIGS. 2B-2D. Cell 230 comprises a lens 235 positioned between segments of the first region 210. Cell 250 comprises a lens 255 positioned between segments of the second region 220. Cell 270 comprises a lens 275 positioned between segments of the first region 210 and an additional lens 280 positioned between segments of the second region 220. As discussed in more detail herein, the various segments of the regions may each comprise similar features that can couple to the lenses to permit the ion field within the cell to be substantially the same as if the collision cell was a continuous structure rather than a segmented structure.

Figure 3:
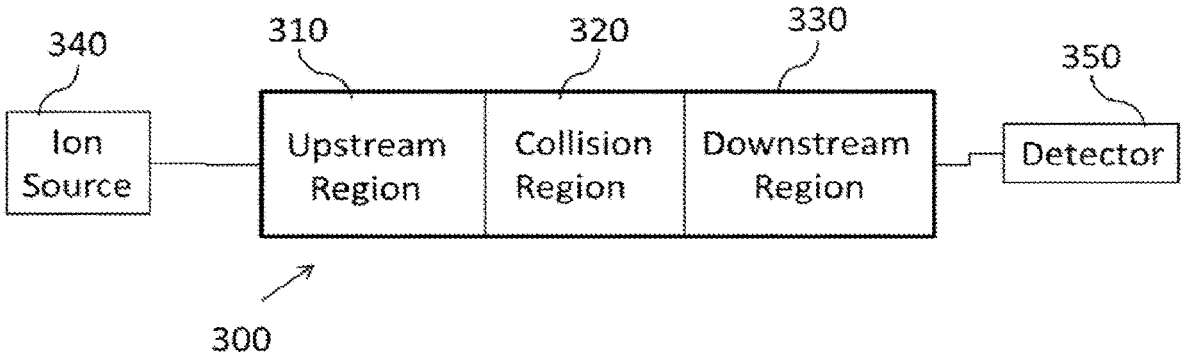
FIG. 3 is a block diagram showing various regions within a collision cell, in accordance with certain examples.

In certain configurations as shown in FIG. 3, the collision cell 300 may include an upstream region 310 fluidically coupled to a collision region 320, and a downstream region 330 fluidically coupled to the collision region 320. The upstream region 310 may be fluidically coupled to an ion source 340, and the downstream region 330 may be fluidically coupled to a detector 350. In some examples, one or more lenses may be present between segments of the upstream region 310, the downstream region 330 or both. In certain embodiments, the lens may be operative as a gas gate or restrictor with the shape of the orifice or aperture in the lens being effective to limit or restrict fluid flows into the cell. This restriction of the fluid flows effectively increases the length of the collision cell by permitting the collision gas pressure in the collision region 320 to be better controlled. In addition, lower volumes of collision gas (or reaction gas) can be introduced into the collision cell, which reduces the pumping speed used for a particular collision (or reaction).

Figure 4:
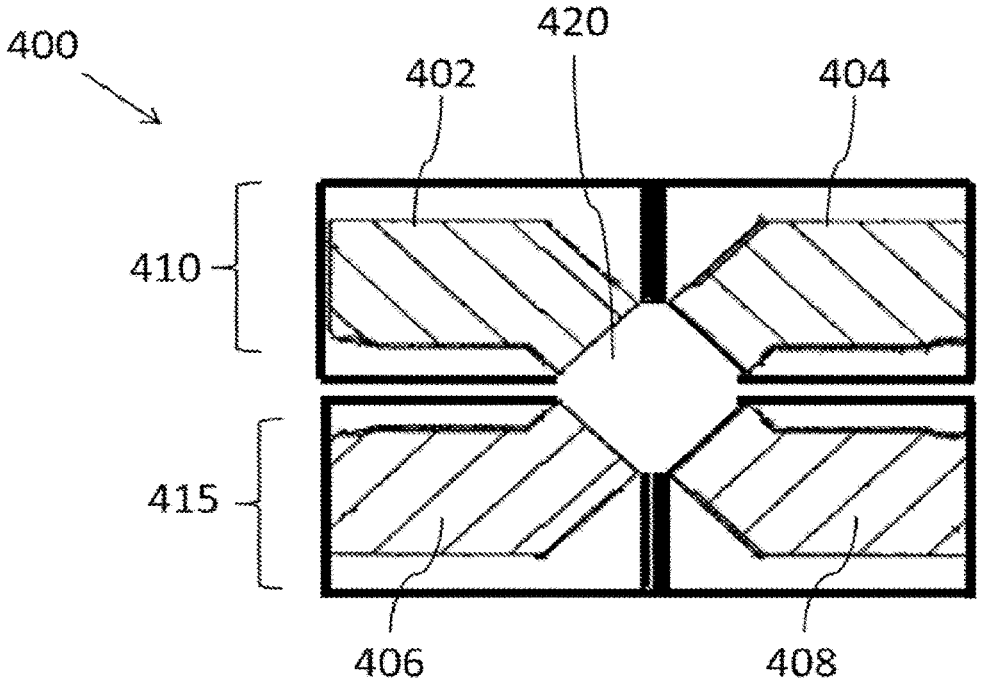
FIG. 4 is a cross-section of a collision cell showing four poles within the cell, in accordance with certain examples.

In certain embodiments, the collision cell may comprise a segmented or sectioned quadrature rod assembly configured to provide a collision region between an upstream region and a downstream region, the sectioned quadrature rod assembly comprising first, second, third, and fourth pole segments in each section of the quadrature rod assembly. The various sections or segments of the quadrature assembly may be electrically coupled to each other through one or more lenses comprising electrically conductive elements. Referring to FIG. 4, a cross-section of a quadrupole of the collision cell 400 shows a plurality of poles 402, 404, 406 and 408 that together can function to provide a quadrupolar field. As shown in FIG. 4, the poles 402, 404 are positioned in a top support plate 410, and the poles 406, 408 are positioned in a bottom support plate 415. The top and bottom plates 410, 415 may be coupled to each other, e.g., with bolts, posts, fasteners, adhesives, or other suitable attachment methods, to provide a fluid tight seal between the plates 410, 415. Coupling of the plates 410, 415 to each other provides an opening 420 where ions may travel through and be filtered or selected. As noted herein, the exact size and shape of the opening 420 can vary. In some examples, the poles 402, 404 of the plate 410 may be arranged about 90 degrees from each other, and the poles 406, 408 of the plate 420 may be arranged about 90 degrees from each other. The poles 402, 404, 406, 408 may be from independent rods, which may be curved in the overall collision cell when they rod segments are assembled, e.g., may be curved through about 90 degrees, 180 degrees, 270 degrees or 360 degrees when the rod segments are assembled. Rods with opposing hyperbolic surfaces can be electrically coupled, and RF voltages (and/or DC voltages if desired) can be provided to the rods with the RF voltages on adjacent poles being out of phase to provide an ion focusing RF field. In a typical use of the collision cell, a vacuum pump is fluidically coupled to the collision cell to maintain a vacuum, e.g., a pressure of about $10^{-6}$ to $10^{-7}$ Torr, and ions and a collision gas are introduced into the cell and permitted to collide and/or react with each other.

Figure 5A:
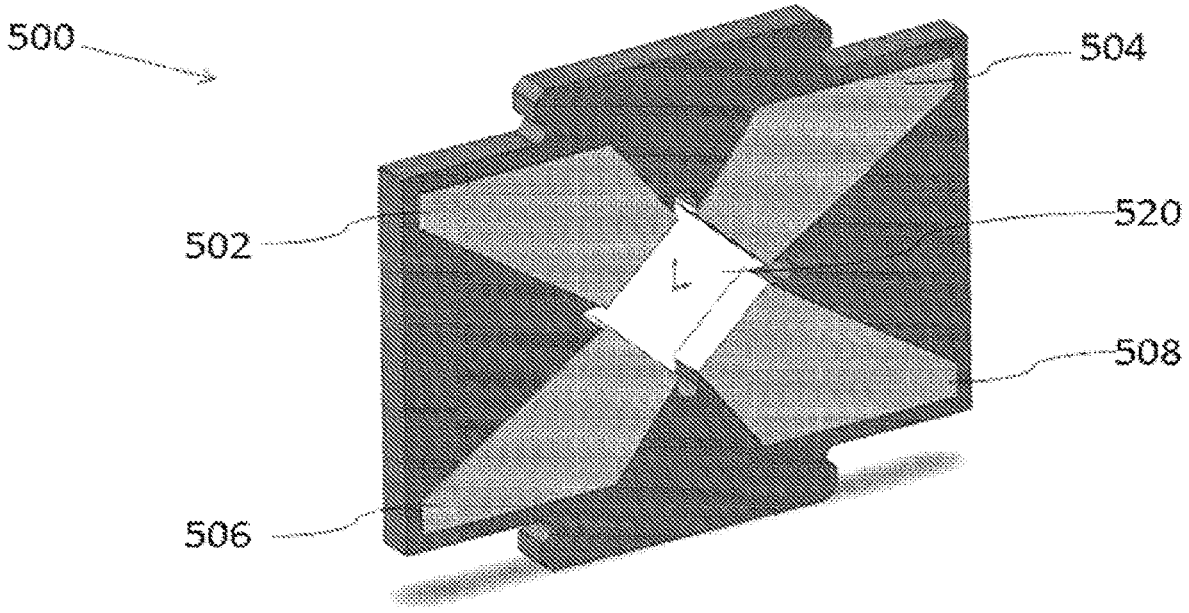
FIGS. 5A and 5B are illustrations of lenses, in accordance with certain examples.

In certain examples, one or more ion lenses may be present between segments of a particular section or region of the collision cell. Referring to FIG. 5A, a lens 500 is shown that is suitable for insertion between segments of a section of the collision cell. The lens 500 comprises areas 502, 504, 506 and 508 that may couple to the poles to permit the RF field to continue at the pole/lens interface. For example, in certain instances a respective area couples to one of the poles of the RF rod assembly to permit the RF field to continue through the lens 500. The other areas may independently couple to one of the other three poles to complete the electrical coupling between the areas 502, 504, 506, 508 and the quadruple segments. The lens 500 comprises an orifice or aperture 520, whose shape and/or size can be selected to limit or control the gas flow in the collision cell. Control of the gas flows within the collision cell permits better control of pressures in the collision cell and may permit substantially similar pressures in different regions of the collision cell if desired. Substantially similar pressures (or reduced pressures compared to existing collision cells) in different regions of the cell provides increased time for collisions (or reactions) which effectively lengthens the collision cell path. In some embodiments, the lens 500 may take the form of a layered printed circuit board (PCB), e.g., a 2-layer printed circuit board, with conductive areas 502, 504, 506 and 508 that may couple to the poles of other segments of the collision cell. In some embodiments, the areas 502, 504, 506 and 508 may be in direct contact with the poles, whereas in other examples, one or more spring contacts (or other contacts) may be present that connect a particular region to an adjacent rod to electrically couple the rod to the conductive area of the lens 500. The conductive areas 502, 504, 506 and 508 may be present on each surface of the lens 500, so the lens 500 can electrically couple to different rod segments of the segmented quadrupole. For example, a first quadrupole segment may abut one conductive area on one surface of the lens 500 and an adjacent quadrupole segment may abut one conductive area on the opposite, other surface of the lens 500. The RF voltages (and/or DC voltages if desired) may be provided from one segment of the quadrupole through the lens 500 and on to another segment of the quadrupole. The presence of the conductive elements 502-508 permits the RF field to continue through the lens 500 without any substantial interruption or distortion. While a square orifice 520 is shown in FIG. 5A for illustration purposes, the exact geometry and size of the orifice 520 may be varied. In some instances, the orifice cross-sectional shape may be round, circular, triangular or other shapes may be present. The size of the orifice may be selected to limit or control the gas flow through the lens 500. In some instances, different lenses of the collision cell may have differently sized or shapes orifices depending on the placement of the lens within the cell. If desired, the orifice may be split into two or more orifices to provide for additional control of gas and/or ion flow through the collision cell.

Figure 5B:
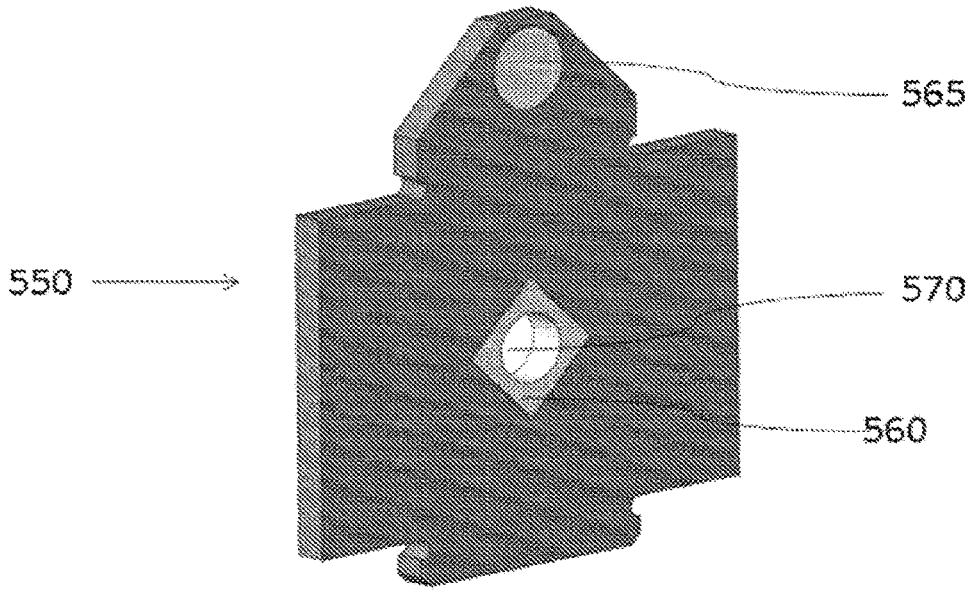

In some embodiments, the collision cell may include one or more lenses configured to push or pull ions into or out of the collision cell. In some instances, the lens may include a centrally located conductive element, e.g., a central conductor, that can couple to, and be floated against, the quadrupole rods of the collision cell. In some embodiments, the surfaces may be present on only an inner surface of the lens. Referring to FIG. 5B, in the lens 550 a middle conductive element 560 is present which may be used to bring out the connection to inter-stage lenses. For example, the lenses can be floated against the RF poles. The lens 550 comprises a conductive region 560 which is electrically coupled to an outer or terminal conductive element 565 through the center of the lens 550. In some instances, the element 565 may be electrically coupled to the element 560 by configuring the lens 550 to be a multi-layered PCB, e.g., a 4-layered PCB, where the middle layers of the PCB are electrically coupled to each of the element 560 and the element 565 to permit current to flow from the element 565 to the element 560. An orifice 570 is present in the lens 550, and similar to lens 500, the shape and size of the orifice 570 may be varied depending on the intended use of the lens 550. In some embodiments, the lens 550 may be used to push or pull ions from the collision cell. Current can be provided to the element 565 and on to the layer 560, and depending on the nature of the current, it can be used to push ions out of one segment of the collision cell (or push ions from one segment of the collision cell to another) or to draw ions into the collision cell, e.g., draw ions into an entrance of the collision cell or draw ions into one segment of the collision cell from another segment of the collision cell. In operation, an electrical contact may be placed against the element 565 to provide current to the element 560. If desired, the electrical contact may be configured similar to the spring contact pins described herein.

Figure 6:
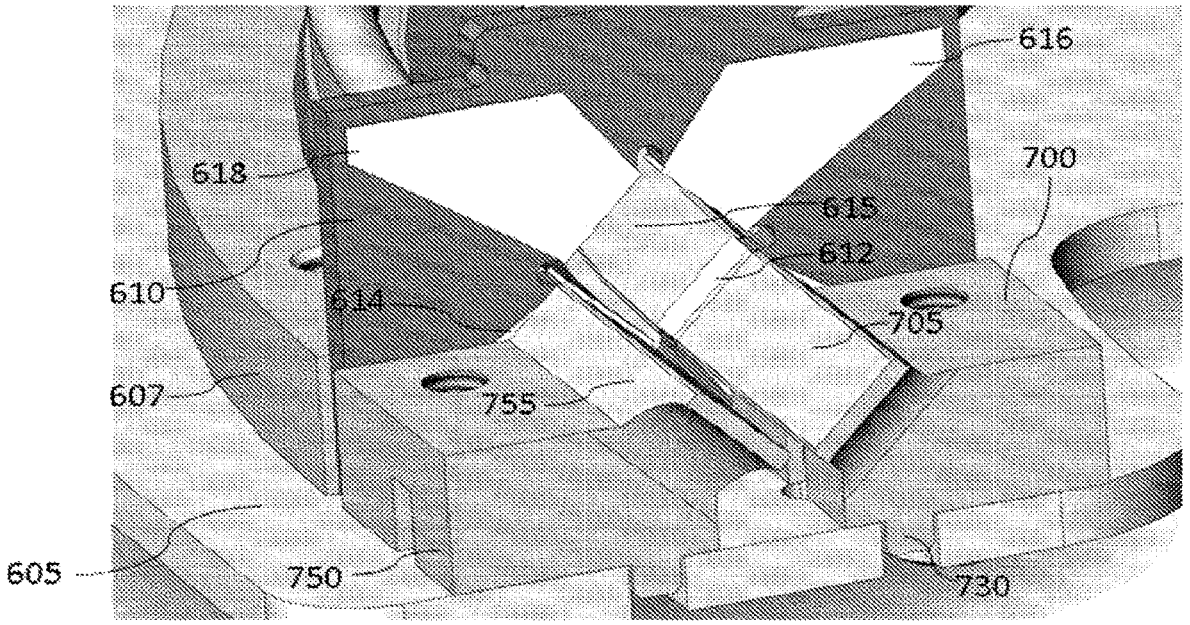
FIG. 6 is an illustration of a lens coupled to two segments, in accordance with certain examples.

In some instances, one or more lenses may be placed at the entrance section or upstream region, e.g., in the first region or the upstream region, of the collision cell. Referring to FIG. 6, an illustration of a lens 610 inserted into a lower support plate 605 of the collision cell is shown. While not shown, the top plate of the collision cell generally mirrors the bottom plate 605 and couples to the bottom plate in a suitable manner to generally seal the fluid path within the collision cell. An entrance segment 700 may be present in the collision cell. The entrance segment 700 comprises a conductive element 705 that is configured to contact a conductive element 612 of the lens 610. The conductive element 612 of the lens is electrically coupled to a quadrupole segment (not shown and behind the lens 610). A similar entrance segment 750 is present that is configured to electrically couple to element 614 of lens 610 through a surface 755. The element 614 of the lens is electrically coupled to a quadrupole segment 607. The presence of the segments 700 and 755 permits the RF field to be present at the terminal portion of the entrance section of the collision cell. Similar entrance segments would be present and coupled to the top support plate. The top plate segments would electrically couple to conductive elements 616 and 618 of the lens 610 to permit a quadrupolar field to be provided and continue through the lens 610 and on to other segments of the collision cell. The orifice 615 can be sized and arranged to limit or control gas or ion flow into the cell.

Figure 7A:
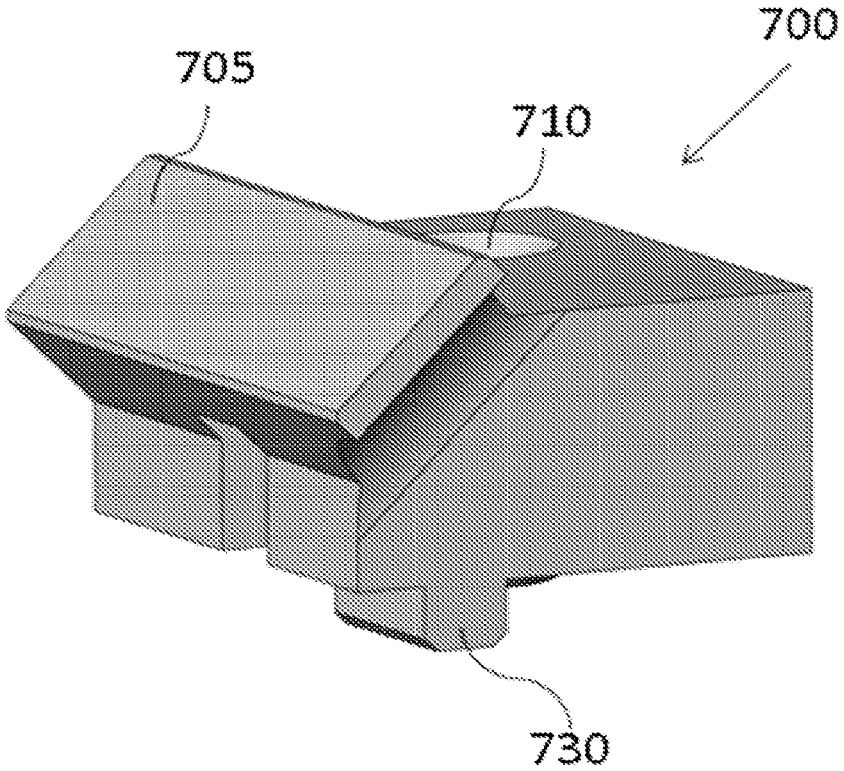
FIGS. 7A and 7B are illustrations of a segment that can be coupled to a lens, in accordance with certain examples.
Figure 7B:
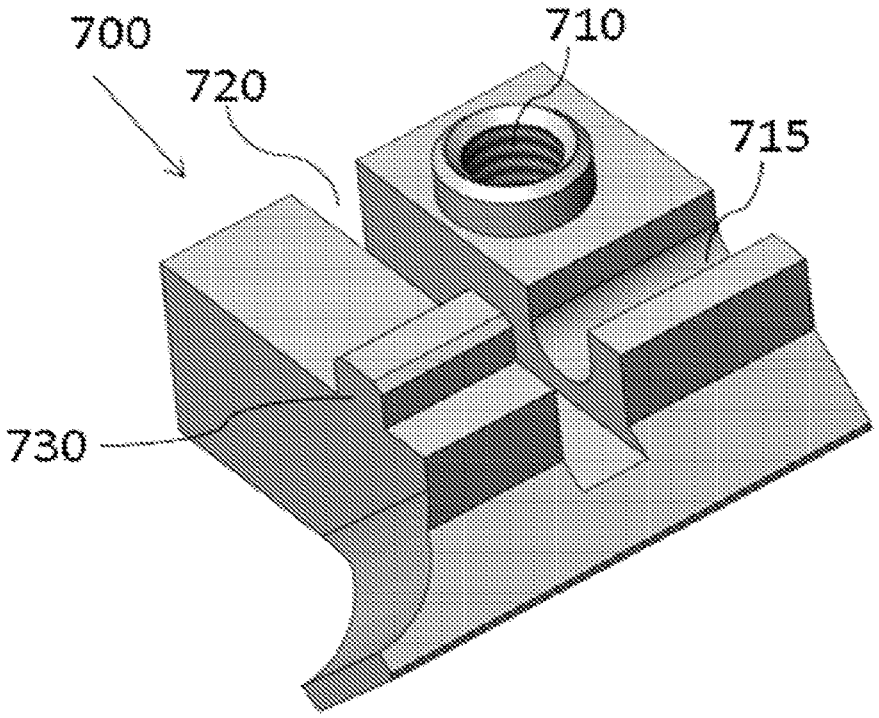
Figure 8:
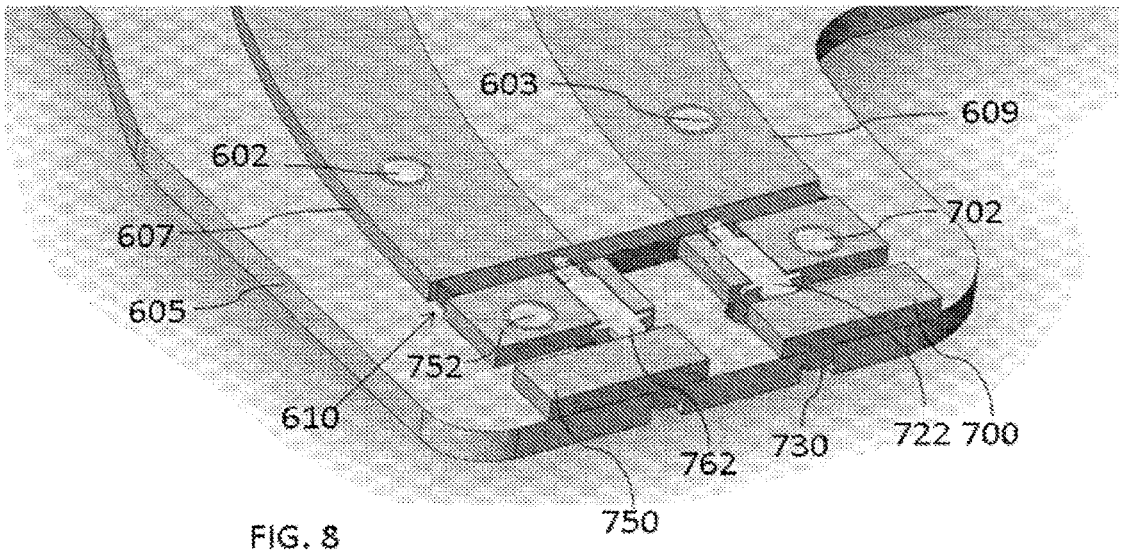
FIG. 8 is an illustration showing placement of a lens in the bottom plate of FIG. 6, in accordance with certain examples.

In certain examples, the segments 700 and 750 may generally be mirror images and include one or more features to couple the segments to the bottom plate of the collision cell. Referring now to FIGS. 7A and 7B, a more detailed view of the segment 700 is shown. The segment 700 comprises the conductive element 705 that can couple to a pole of the quadrupole, an aperture 710 that may comprise threads to receive a screw or bolt to couple the segment 700 to the bottom plate (or top plate as the case may be), a groove 715 and alignment features 720 and 730 to facilitate proper placement of the segment 700 on one of the top or bottom plates. In the configuration shown in FIGS. 7A and 7B, a slot 720 and a boss 730 are each present to permit coupling of the segment 700 to a plate in a single orientation. The groove 715 can be sized and arranged to receive a coupler to couple the segment 700 to the lens and to the other segments of the collision cell. In some embodiments, the groove 720 may be sized and arranged to receive a pin contact that can be biased against the lens and/or other segments of the cell to hold the entrance segment in place. For example and referring to the cross-section shown in FIG. 8 and again to FIG. 6, spring contacts 722 and 762 may be integral to the segments 700 and 750, respectively, to assist in retaining the segments 700 and 750 in the bottom plate 605. If desired, the pins 722 and 762 may each contact one of the conductive areas of the lens and permit transfer of the RF currents to/from the segments to the conductive areas of the lens 610 and to other poles of other segments of the collision cell. In assembly, the lens 610 may be pressed into the slot of the bottom plate 605 and sandwiched between segments of the collision cell. For example, the lens 610 may be placed in a slot between quadrupole segments 607, 609 and entrance segments 700, 750. Spring contact pin or pogo pin 722 may be used to electrically couple the segment 700 to the segment 609. Similarly, spring contact pin or pogo pin 762 may be used to electrically couple segment 750 to the segment 607. The segments 607, 609 are coupled to the bottom plate 605 through fasteners 602, 603, respectively. Similarly, the segments 700, 750 are coupled to the bottom plate 605 through fasteners 702, 752, respectively.

In certain examples, in use of the lens 610, the lens may be positioned at the entrance of the collision cell and be operative as a conductive limiter. In particular, gas flows entering the cell can be limited by the shape and size of the aperture 615 in the lens 610. In some instances, a reduction in gas flow into the collision cell can increase the overall effective length of the collision segment. Use of a lens at the entrance of the cell can permit maintenance of the set collision gas pressures close to the exit and entrance of the cell. This control can permit use of less collision gas and permit use of lower overall pumping speeds, which may permit the use of cheaper pumps in the system.

In certain instances, the entrance section or upstream region of the collision cell may be fluidically coupled to a collision region of the collision cell. If desired, one or more lenses may be included in the collision region, whereas in other instances no lenses are present in the collision region of the collision cell. Without wishing to be bound by any particular scientific theory, in the collision region of the cell, ions which enter the cell are fragmented into molecular ions in the gas phase. The ions may be guided by the RF field and collided with a collision gas, e.g., helium, nitrogen, argon or xenon with heavier gases typically used, to permit formation of neutral species and ions. In some instances, the species are fragmented into smaller ionized species which may then be analyzed. In embodiments described herein using a quadrupole, the oscillating fields of the quadrupole can be used to stabilize or destabilize the path of the ions. Ions with a selected mass-to-charge ratio are passed through a particular field, and the field may be changed or swept to select ions having different mass-to-charge ratios. While not shown, the segmented systems described herein may be used with hexapole or octapole systems by reconfiguring the lenses with six or eight separate conductive elements, respectively.

Figure 9:
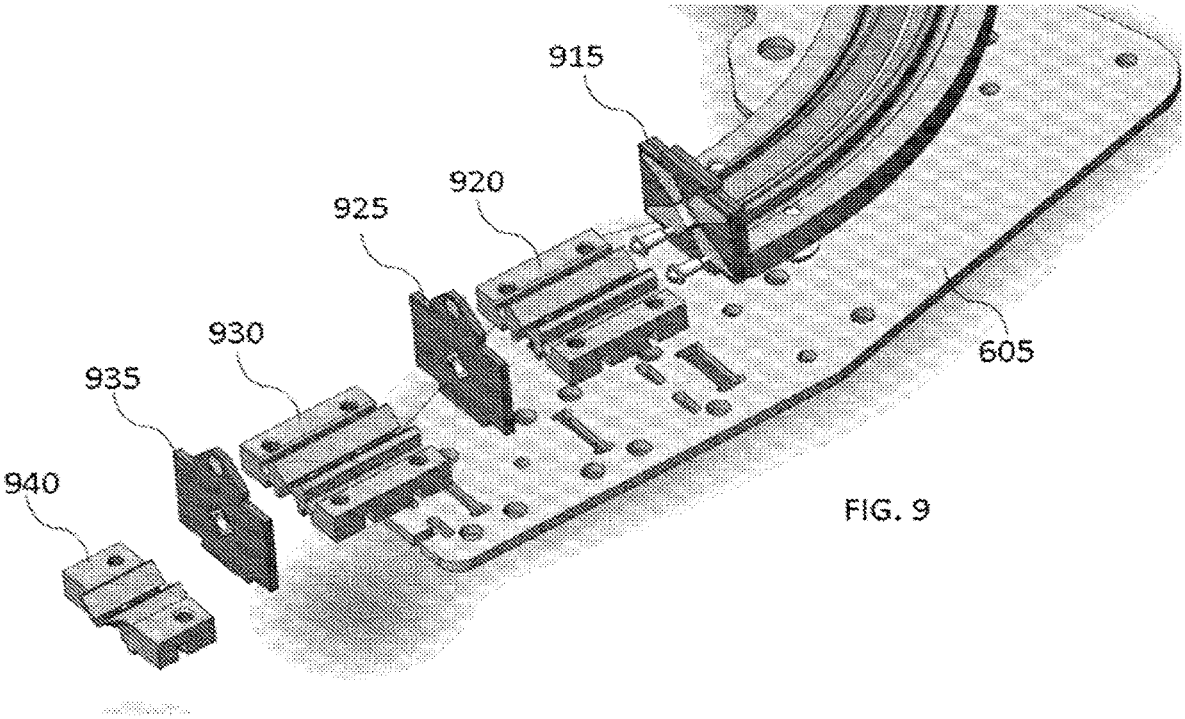
FIG. 9 is an illustration showing an exploded view of various components at an exit end of a collision cell, in accordance with certain examples.

In some embodiments, the collision region may be fluidically coupled to a downstream or another region may include one or more lenses. Certain illustrations are described below with reference to three lenses being present in the downstream region of the collision cell. It will be recognized by the person of ordinary skill in the art, given the benefit of this disclosure, that less than three lenses or more than three lenses may be present. Referring now to FIG. 9, an exploded view of an exit section of the collision cell is shown. The collision cell comprises a bottom plate 605 that is sized and arranged to receive various components that can couple to the bottom plate 605. For example, the bottom plate 605 may comprise openings, grooves, slots, etc. that may be configured to receive the components of the collision cell and couple to the components through one or more fasteners or other attachment methods. In some embodiments, one or more fasteners may be inserted into the bottom plate 605 from the bottom and through one or more components that are configured to couple to the bottom plate 605 to retain the component to the bottom plate 605. In some examples, the fastener may be a screw or bolt that can couple to an opening or aperture, e.g., one with threads, of the component to assemble the component to the bottom plate 605. In the particular configuration shown in FIG. 9, the exit section or downstream stage may comprise lenses 915, 925 and 935 with exit segments 920 and 930 between the lenses 925 and 935 and exit segment 940 at the exit end of the collision cell. Ions which are selected by the collision region with a particular mass-to-charge ratio are received by the downstream region where they may be cooled, e.g., decelerated, prior to exiting the collision cell. The lens 915 may be, for example, similar to the lens 610, e.g., may be a lens comprising a 2-layer PCB. The potential of the lens 915 may be selected such that ions which pass through the lens generally do not flow back into the collision cell. Ions may then enter into the regions formed by components 920-940 where, for example, they can be pushed out of the collision cell by the lenses 925 and 935.

Figure 10:
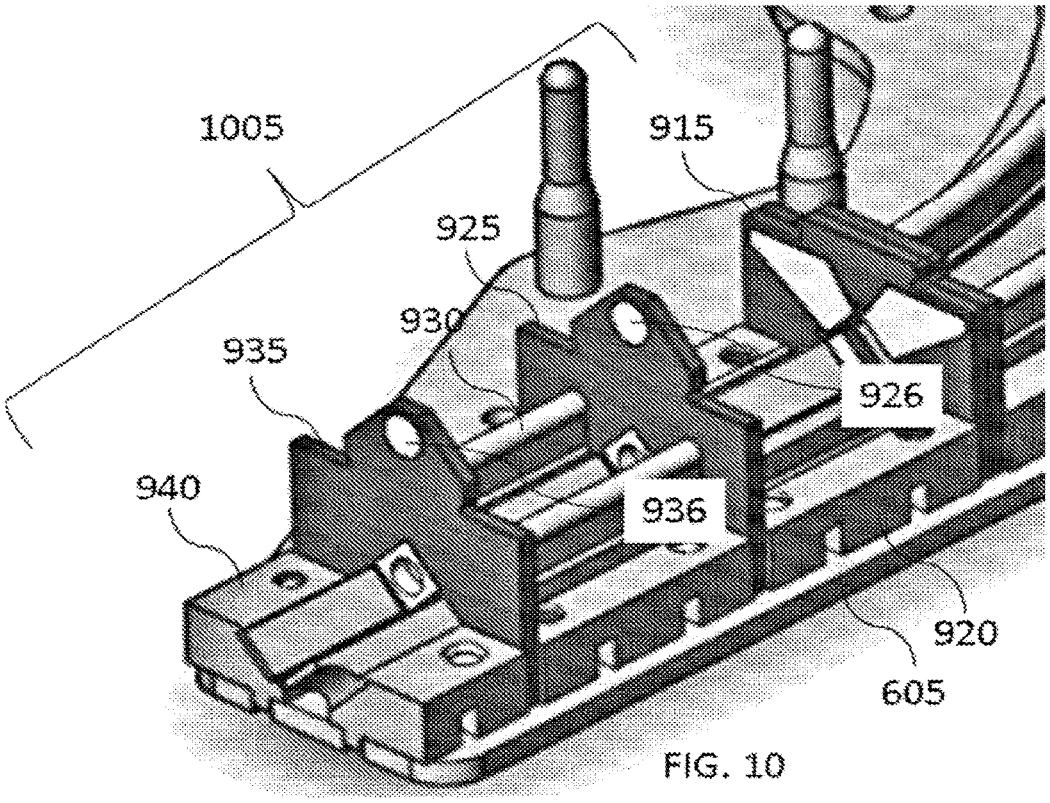
FIG. 10 is an illustration showing an assembled view of the components shown in FIG. 9, in accordance with certain examples.

In certain examples and referring to FIG. 10, an assembled exit section 1005 is shown. In some embodiments, a cooling gas, e.g., helium, is introduced into the section 1005 to assist in deceleration of the ions within the section 1005. Once the ions are decelerated, a suitable potential or current can be applied to the lens 925 through the electrical coupler 926 and/or through the lens 935 through the coupler 936. In use, cooled ions may pass through the lens 930 in the general direction toward the lens 935. The potential of the lenses can be selected to push the ions toward the segment 940 and out of the collision cell. By decelerating the ions received from the collision region, the ions can be focused into a more defined beam, but deceleration may result in sufficient energy loss that prohibits the ions from exiting the collision cell. The lenses 925 and 935 can be used to push and/or pull cooled ions to guide the ions out of the collision cell and to another component or device, e.g., to another stage, to a detector or to other components.

Figure 11:
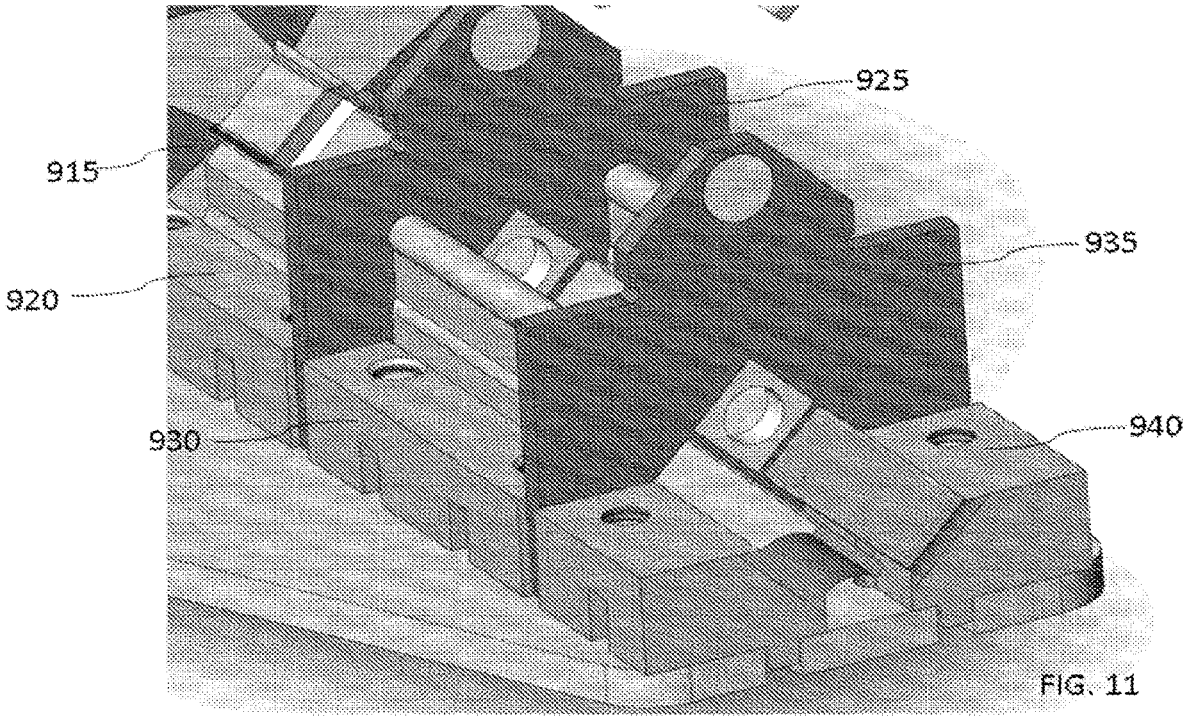
FIG. 11 is another illustration showing an assembled view of the components shown in FIG. 9, in accordance with certain examples.

In certain embodiments and referring to FIG. 11, another view of the exit section is shown. To cool the ions, the cooling section comprises a plurality of segments 930, 940 that can be used to decelerate the entering ions and/or push the ions out of the collision cell. As shown in the configuration of FIG. 11, the conductive inner portions of the lenses 925 and 935 generally do not contact the exit segments 930, 940. As ions enter into the region between the lenses 925 and 935, they are decelerated and can be pushed out of the collision cell toward the segment 940 by the potential on the lenses 925 and 935. If desired, the lens 935 can be configured to pull ions toward it while the lens 925 is configured to push ions away from it toward the lens 935. In some instances, the potential on the lenses 925 and 935 may be controlled such that one lens is on and one lens is off. In other instances, the potential may be reversed such that a lens can push or pull ions depending on the exact applied potential. For example, the lens 935 may be configured to pull ions in one configuration and then configured to push ions in another configuration. By selecting the potentials applied to the lenses, the ions can be forced to exit the exit section in a desired manner and at a desired time.

Figure 12:
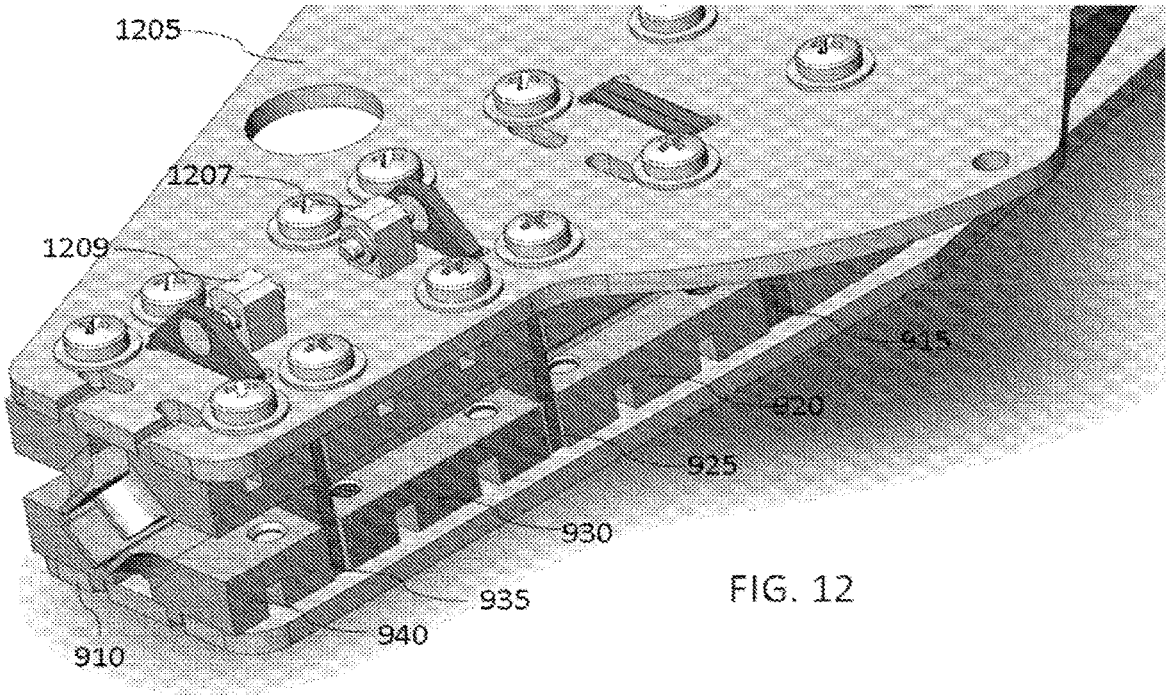
FIG. 12 is an illustration showing the bottom and top plates of the collision cell coupled to each other, in accordance with certain examples.
Figure 13:
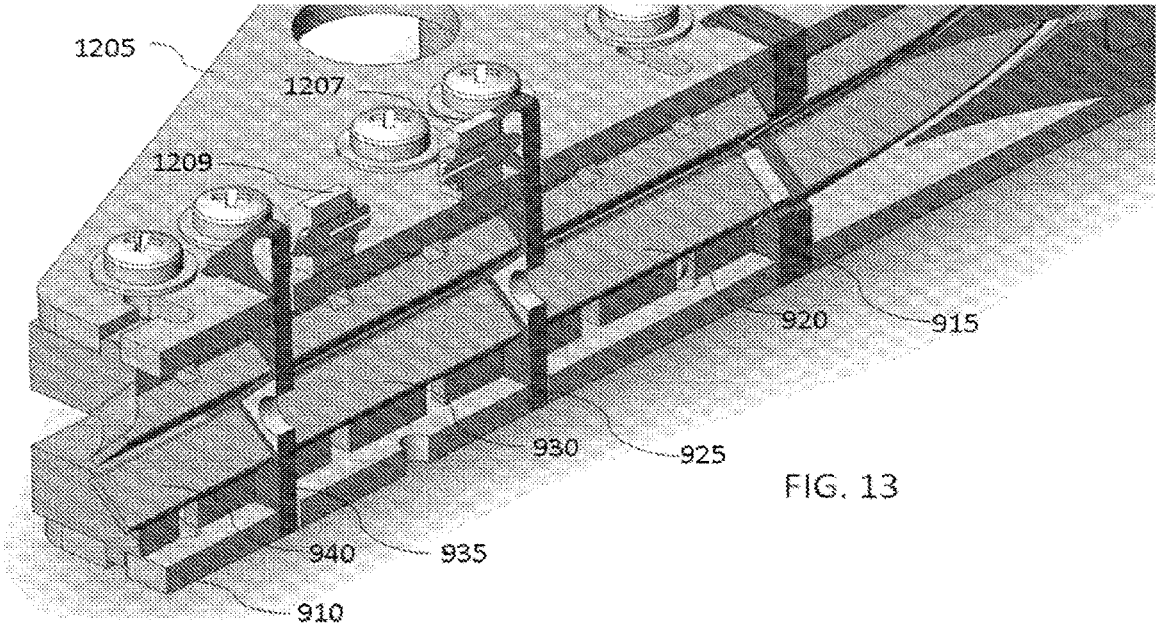
FIG. 13 is cross-section of the illustration of FIG. 12, in accordance with certain examples.

In some embodiments, the potential may be applied to the lenses 925 and 935 by coupling the lenses 925, 935 to one or more power sources through connectors on the upper surfaces of the lenses 925, 935. For example and referring to FIG. 12, a spring contact 1207 on a top plate 1205 is present that is configured to electrically couple a power source (not shown) to the lens 925. Similarly, a spring contact 1209 is present on the top plate 1205 that couples the lens 935 to a power source. In the cut away view shown in FIG. 13, the spring contacts sits on the top plate 1205. An electrical connection can be provided between the spring contact posts to provide current from a power source to the lenses 925, 935. In some embodiments, different currents or potentials may be provided to each of the lenses 925, 935. In certain configurations, the potential on each lens 925, 935 may be independently controlled using a controller, microprocessor or other components of the instrument. In other instances, it may be desirable to couple the spring contacts 1207, 1209 to one or more of the RF rods in the collision cell. In such configurations, a through hole in the top plate 1205 may exist to permit electrical coupling of the spring contacts 1207, 1209 with one or more RF rods of the collision cell. The post of the spring contacts may include suitable components to alter the potential or current, e.g., resistors, circuitry, etc., received from the RF rods to provide a suitable electric field or electric potential to push or pull the ions in a desired direction. It will be within the ability of the person of ordinary skill in the art, given the benefit of this disclosure, to configure the lenses 925, 935 in a suitable manner to push and pull ions. As shown in FIGS. 12 and 13, a bottom plate 910 may be coupled to the top plate 1205.

Figure 14:
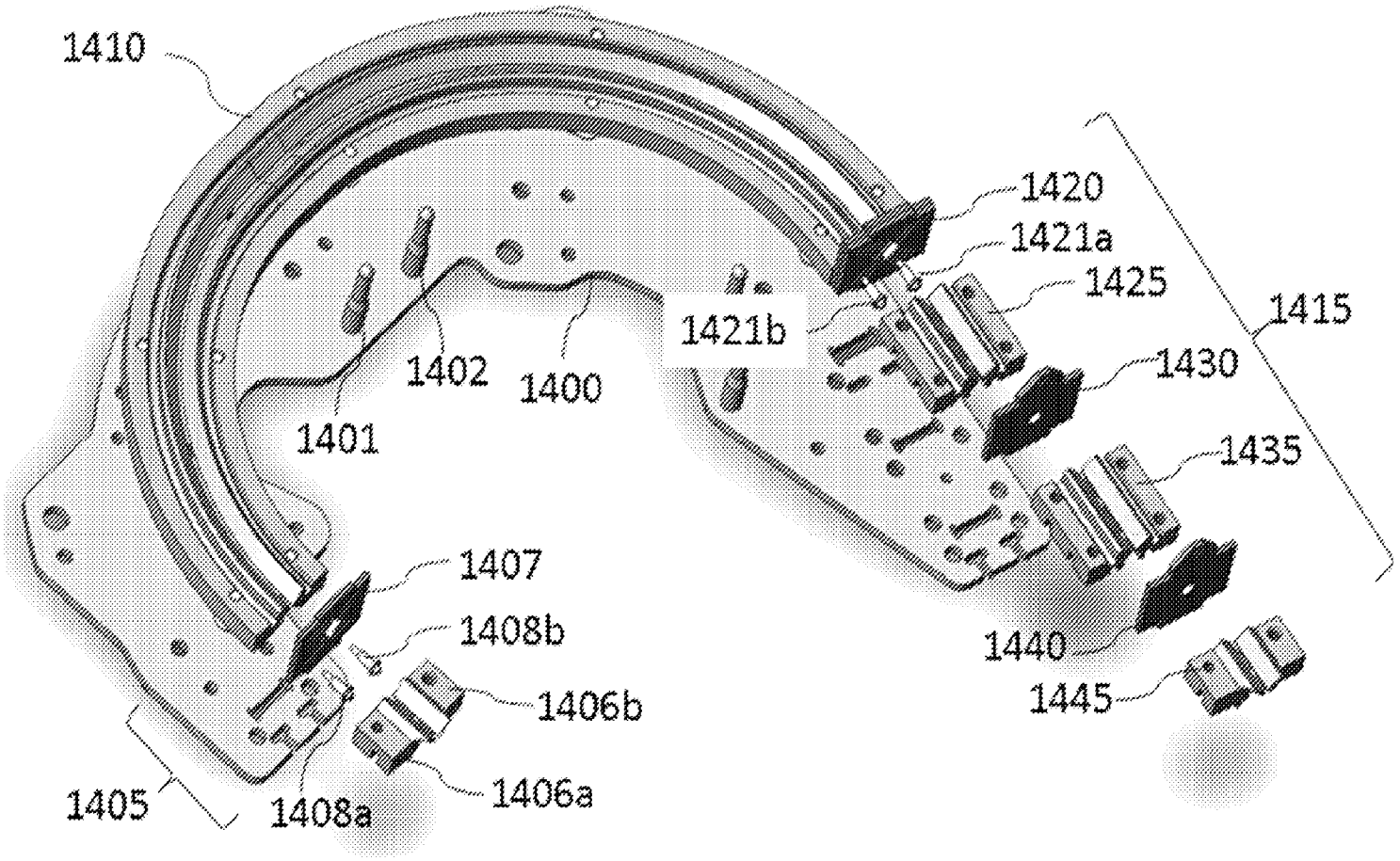
FIG. 14 is an illustration of a collision cell comprising an entrance section, a collision section and a cooling section, in accordance with certain examples.
Figure 15:
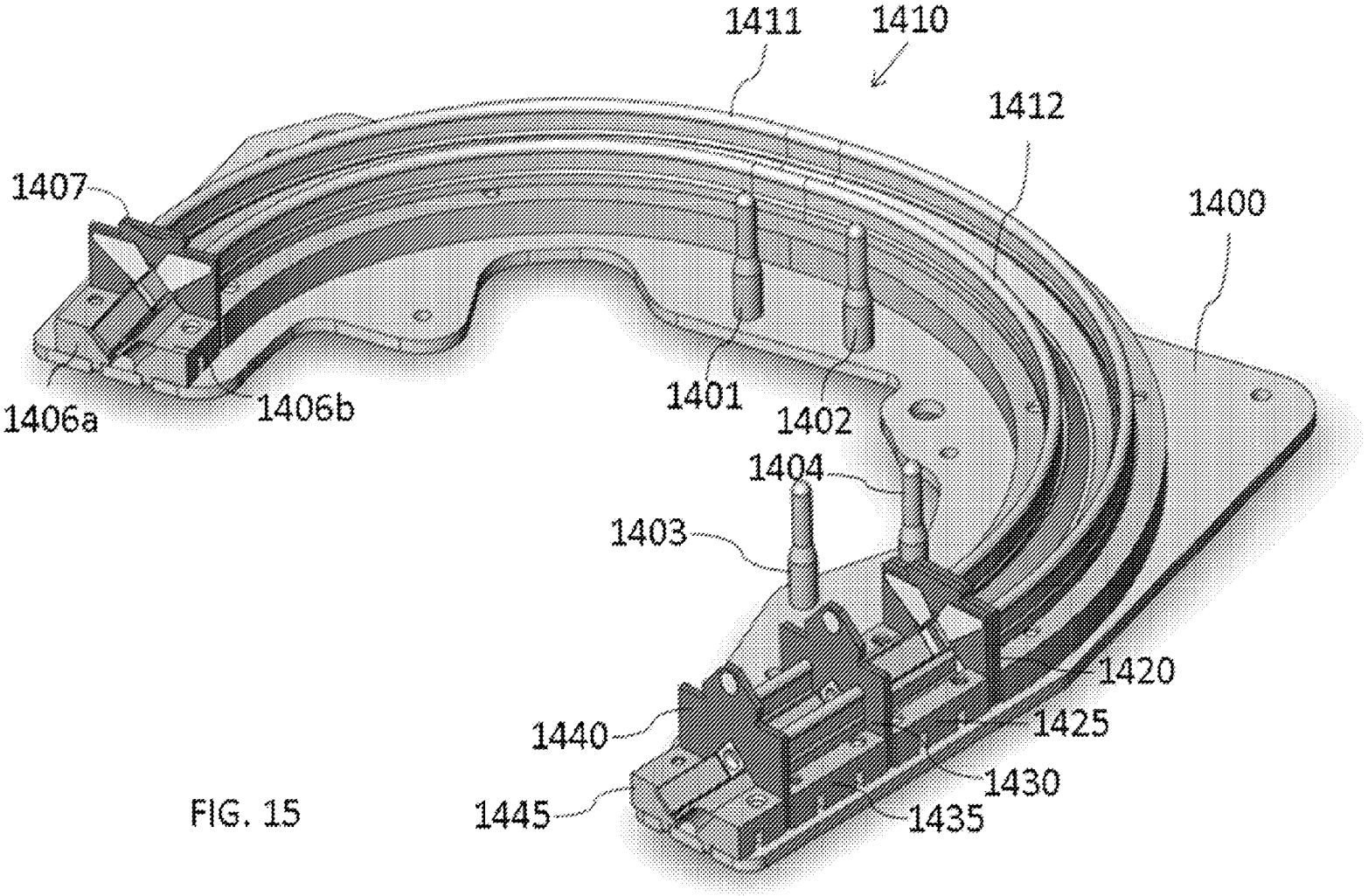
FIG. 15 is an illustration showing an assembled view of the components shown in FIG. 14, in accordance with certain examples.

In certain embodiments, a collision cell may comprise a top plate and a bottom plate that comprises an entrance section with a lens, a collision section coupled to the entrance section and an exit section comprising at least one lens and coupled to the collision section. One example of the bottom plate is shown in FIGS. 14 and 15. While not shown, the top plate would generally be a mirror image that would include suitable components to couple to the components of the bottom plate. The bottom plate 1400 comprises an entrance section 1405, a collision section 1410 and an exit section 1415. The entrance section 1405 comprises entrance segment blocks 1406*a*, 1406*b* and a lens 1407. The entrance segments 1406*a*, 1406*b* are coupled to the lens 1407 through pogo pins 1408*a*, 1408*b*, respectively. The lens 1407 is operative as a gas restrictor while permitting the RF fields to remain intact. The collision section 1410 is configured as a curved quadrupole and curves through about 180 degrees from the beginning of the collision section 1410 to the end of the collision section 1410. FIG. 15 shows two of the curved rods 1411, 1412 of the quadrupole. Similar curved poles are positioned underneath the poles 1411, 1412 to provide four rods arranged in a generally square arrangement similar to that shown in FIG. 4. The bottom plate 1400 comprises guide rods 1401-1404 coupled to the bottom plate 1400 to assist in coupling and alignment of the top plate (not shown) to the bottom plate. The exit section 1415 of the collision cell comprises two lenses (collectively element 1420) sandwiched together. The lenses 1420 are coupled to an exit segment 1425 through pogo pins 1421*a*, 1421*b*. Another lens 1430 is coupled to the segment 1425 and to the exit segment 1435. The segment 1430 is coupled to a fourth lens 1440, which is coupled to an exit segment 1445. The exact configuration of the lenses 1420, 1430 and 1440 may vary, but in certain instances the lenses 1420 are effective to couple to the quadrupolar rods, and the lenses 1430, 1440 can be configured to push and/or pull ions through the exit segments 1435 and 1445.

Figure 16:
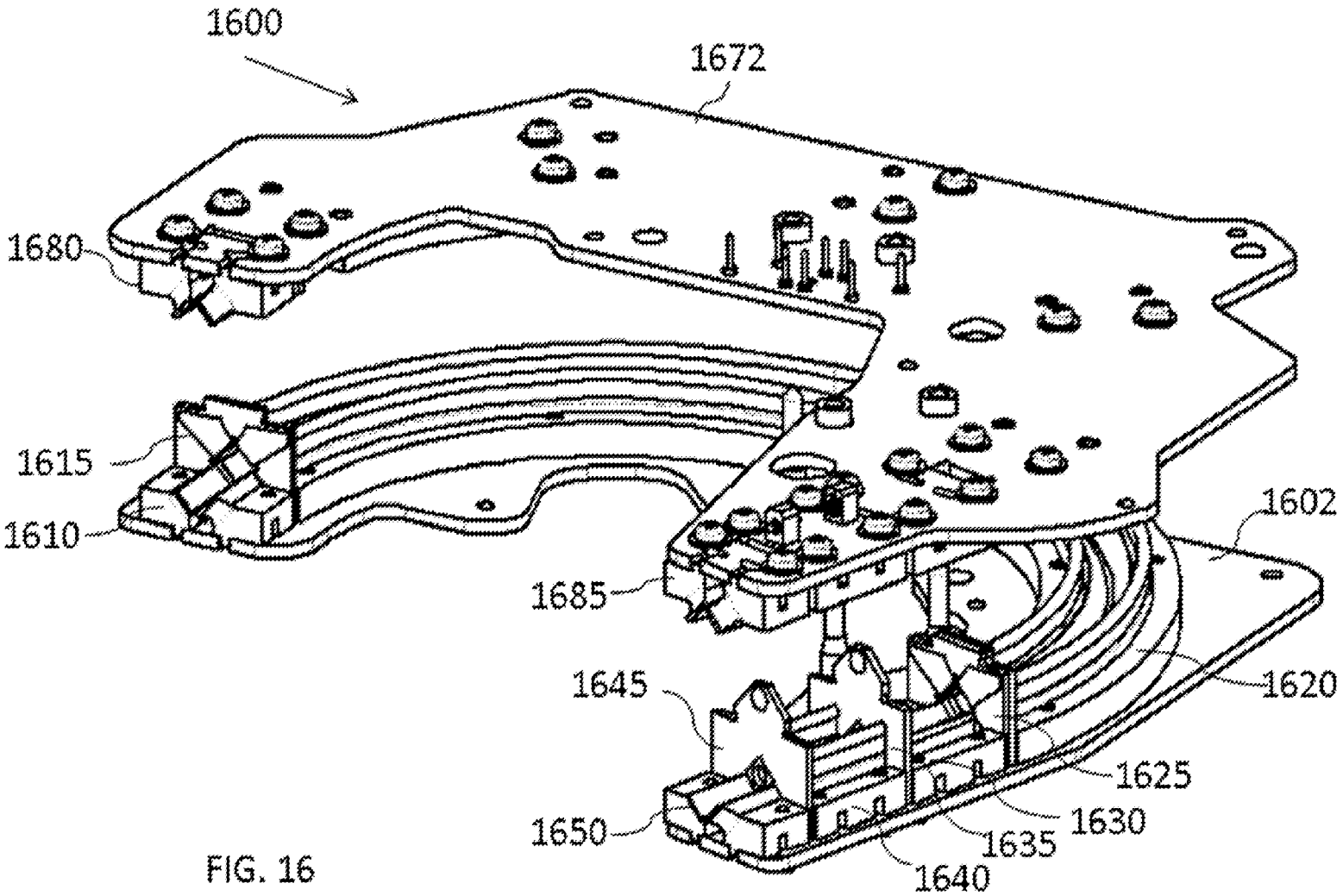
FIG. 16 is a schematic showing the top and bottom plates of the collision cell after separation from each other, in accordance with certain examples.

In certain examples and referring to FIG. 16, a collision cell 1600 comprises a bottom plate 1602 and a top plate 1672. The bottom plate 1602 comprises an entrance segment 1610 coupled to a first lens 1615. A corresponding entrance segment 1680 on the top plate 1672 is shown for illustration purposes. The bottom plate 1602 shows a collision section 1620 coupled to an exit section which comprises lenses 1625, 1635 and 1645 coupled to intervening exit segments 1630, 1640 and 1650, respectively. For reference, a corresponding exit segment 1685 is shown on the top plate 1672. The top plate 1672 and the bottom plate 1602 couple to each other through a friction fit and may include gaskets, outer seals or other components to provide a generally fluid tight seal to permit vacuum operation of the collision cell 1600. If desired, one or more fasteners can be used to couple the top plate 1672 and the bottom plate 1602 to each other.

Figure 17:
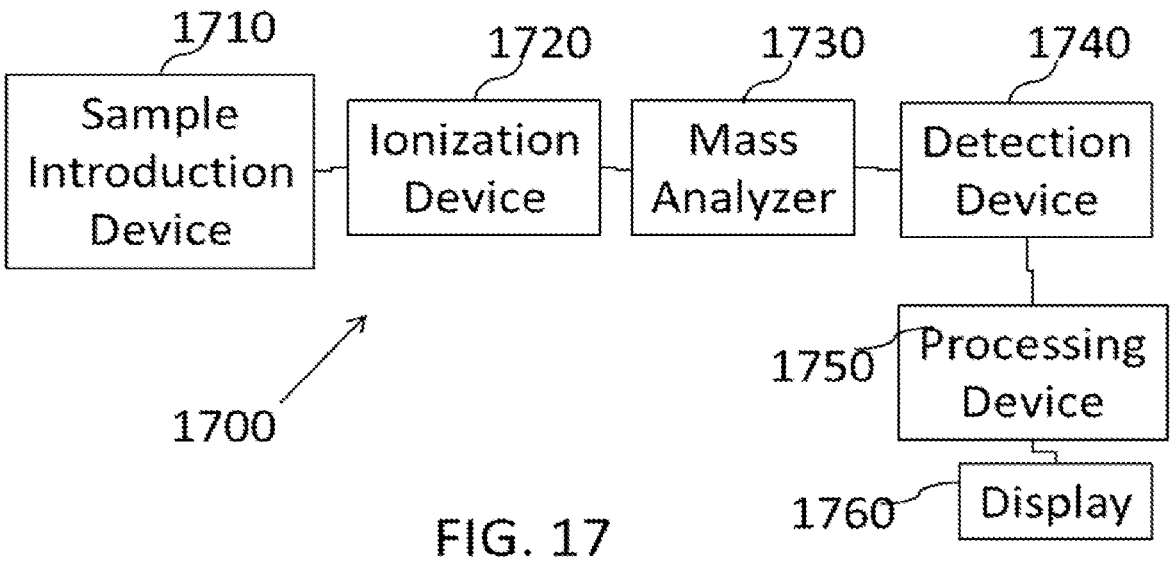
FIG. 17 is a block diagram of a system comprising the collision cell described herein, in accordance with certain examples.

In certain embodiments, the collision cells described herein can be used in a mass spectrometer. An illustrative MS device is shown in FIG. 17. The MS device 1700 includes a sample introduction device 1710, an ionization device 1720, a mass analyzer 1730, a detection device 1740, a processing device 1750 and a display 1760. The sample introduction device 1710, ionization device 1720, the mass analyzer 1730 and the detection device 1740 may be operated at reduced pressures using one or more vacuum pumps. In certain examples, however, only the mass analyzer 1730 and the detection device 1740 may be operated at reduced pressures. The sample introduction device 1710 may include an inlet system configured to provide sample to the ionization device 1720. The inlet system may include one or more batch inlets, direct probe inlets and/or chromatographic inlets. The sample introduction device 1710 may be an injector, a nebulizer or other suitable devices that may deliver solid, liquid or gaseous samples to the ionization device 1720. The ionization device 1720 may be any one or more ionization devices commonly used in mass spectrometer, e.g., may be any one or more of the devices which can atomize and/or ionize a sample including, for example, plasma (inductively coupled plasmas, capacitively coupled plasmas, microwave-induced plasmas, etc.), arcs, sparks, drift ion devices, devices that can ionize a sample using gas-phase ionization (electron ionization, chemical ionization, desorption chemical ionization, negative-ion chemical ionization), field desorption devices, field ionization devices, fast atom bombardment devices, secondary ion mass spectrometry devices, electrospray ionization devices, probe electrospray ionization devices, sonic spray ionization devices, atmospheric pressure chemical ionization devices, atmospheric pressure photoionization devices, atmospheric pressure laser ionization devices, matrix assisted laser desorption ionization devices, aerosol laser desorption ionization devices, surface-enhanced laser desorption ionization devices, glow discharges, resonant ionization, thermal ionization, thermospray ionization, radioactive ionization, ion-attachment ionization, liquid metal ion devices, laser ablation electrospray ionization, or combinations of any two or more of these illustrative ionization devices. The mass analyzer 1730 may take numerous forms depending generally on the sample nature, desired resolution, etc., and exemplary mass analyzers can include one or more of the collision cells described herein or other components as desired. The detection device 1740 may be any suitable detection device that may be used with existing mass spectrometers, e.g., electron multipliers, Faraday cups, coated photographic plates, scintillation detectors, etc., and other suitable devices that will be selected by the person of ordinary skill in the art, given the benefit of this disclosure. The processing device 1750 typically includes a microprocessor and/or computer and suitable software for analysis of samples introduced into MS device 1700. One or more databases may be accessed by the processing device 1750 for determination of the chemical identity of species introduced into MS device 1700. Other suitable additional devices known in the art may also be used with the MS device 1700 including, but not limited to, autosamplers, such as AS-90plus and AS-93plus autosamplers commercially available from PerkinElmer Health Sciences, Inc.

In certain embodiments, the mass analyzer 1730 of the MS device 1700 may take numerous forms depending on the desired resolution and the nature of the introduced sample. In certain examples, the mass analyzer is a scanning mass analyzer, a magnetic sector analyzer (e.g., for use in single and double-focusing MS devices), a quadrupole mass analyzer, an ion trap analyzer (e.g., cyclotrons, quadrupole ions traps), time-of-flight analyzers (e.g., matrix-assisted laser desorbed ionization time of flight analyzers), and other suitable mass analyzers that may separate species with different mass-to-charge ratios and may comprise one or more of the collision cells described herein. In some embodiments, two stages may be included where one stage comprises a collision cell as described herein. In some examples, the MS devices disclosed herein may be hyphenated with one or more other analytical techniques. For example, MS devices may be hyphenated with devices for performing liquid chromatography, gas chromatography, capillary electrophoresis, and other suitable separation techniques. When coupling an MS device with a gas chromatograph, it may be desirable to include a suitable interface, e.g., traps, jet separators, etc., to introduce sample into the MS device from the gas chromatograph. When coupling an MS device to a liquid chromatograph, it may also be desirable to include a suitable interface to account for the differences in volume used in liquid chromatography and mass spectroscopy. For example, split interfaces may be used so that only a small amount of sample exiting the liquid chromatograph may be introduced into the MS device. Sample exiting from the liquid chromatograph may also be deposited in suitable wires, cups or chambers for transport to the ionization devices of the MS device. In certain examples, the liquid chromatograph may include a thermospray configured to vaporize and aerosolize sample as it passes through a heated capillary tube. Other suitable devices for introducing liquid samples from a liquid chromatograph into a MS device will be readily selected by the person of ordinary skill in the art, given the benefit of this disclosure. In certain examples, MS devices can be hyphenated with each other for tandem mass spectroscopy analyses.

Figure 18:
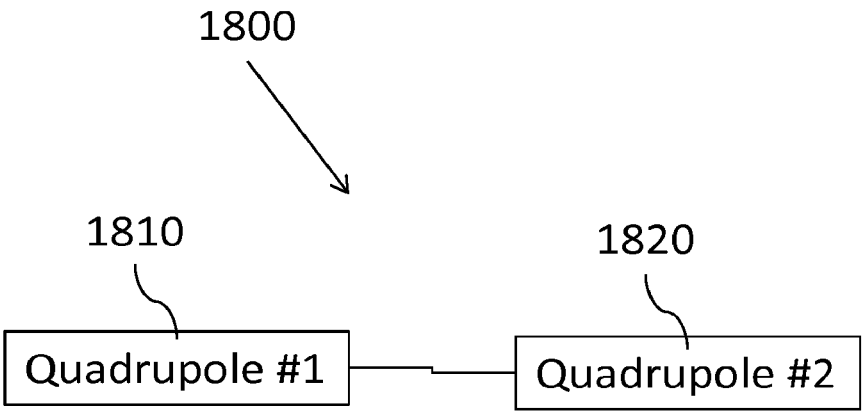
FIG. 18 is a block diagram showing two quadrupoles, in accordance with certain examples.

In certain embodiments, the collision cells described herein may be present in a first quadrupole that is coupled to a second device comprising a quadrupole. Referring to FIG. 18, a first quadrupole 1810 is coupled to a second quadrupole 1820 such that ions may be provided from one quadrupole to the next quadrupole. In a first configuration, the first quadrupole 1810 may comprise one of the collision cells described herein, and the second quadrupole 1820 may or may not comprise one of the collision cells described herein, e.g., may include a conventional collision cell or may include other components commonly present in existing quadrupole systems. In another configuration, the second quadrupole 1820 may comprise one of the collision cells described herein, and the first quadrupole 1810 may or may not comprise one of the collision cells described herein, e.g., may include a conventional collision cell or may include other components commonly present in existing quadrupole systems. The quadrupoles 1810, 1820 may be coupled directly to each other, e.g., without any intervening components or systems, or may be indirectly coupled to each other, e.g., separated by one or more other components or systems. While quadrupoles are shown in FIG. 18, one of the components may instead be a hexapole, octapole or other component that may be coupled to one of the collision cells described herein. For example, quadrupole 1810 or 1820 may be replaced with a magnetic sector device or other suitable components and the remaining quadrupole may comprise the collision cell described herein.

Figure 19:
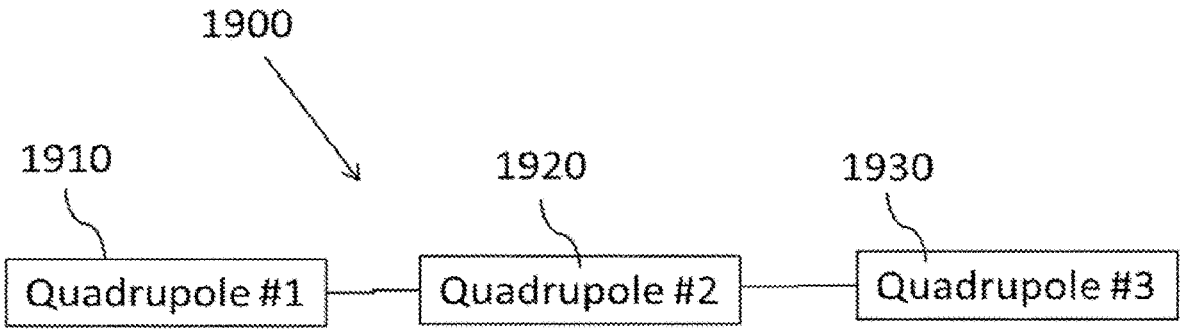
FIG. 19 is a block diagram showing three quadrupoles, in accordance with certain examples.

In additional configurations, a system comprising more than two quadrupoles in which at least one of the quadrupoles comprises a collision cell as described herein is provided. Referring to FIG. 19, a system 1900 comprises three quadrupoles 1910, 1920 and 1930 coupled to each other. In a first configuration, the first quadrupole 1910 may comprise one of the collision cells described herein, and the second and third quadrupoles 1920, 1930 may or may not comprise one of the collision cells described herein, e.g., may include a conventional collision cell or may include other components commonly present in existing quadrupole systems. In another configuration, the second quadrupole 1920 may comprise one of the collision cells described herein, and the first and third quadrupoles 1910 and 1930 may or may not comprise one of the collision cells described herein, e.g., may include a conventional collision cell or may include other components commonly present in existing quadrupole systems. In an additional configuration, the third quadrupole 1930 may comprise one of the collision cells described herein, and the first and second quadrupoles 1910 and 1920 may or may not comprise one of the collision cells described herein, e.g., may include a conventional collision cell or may include other components commonly present in existing quadrupole systems. The quadrupoles 1910, 1920 and 1930 may be coupled directly to each other, e.g., without any intervening components or systems, or may be indirectly coupled to each other, e.g., separated by one or more other components or system. While quadrupoles are shown in FIG. 19, one of the components may instead be a hexapole, octapole or other component that may be coupled to one of the collision cells described herein. For example, quadrupole 1910, 1920 or 1930 may be replaced with a magnetic sector device or other suitable components, and one or more of the remaining quadrupoles may comprise a collision cell as described herein. Even though three quadrupoles are shown in FIG. 19, more than three quadrupoles may be present in a system if desired, e.g., four, five, six or more quadrupoles may be present in the system.

Figure 20A:
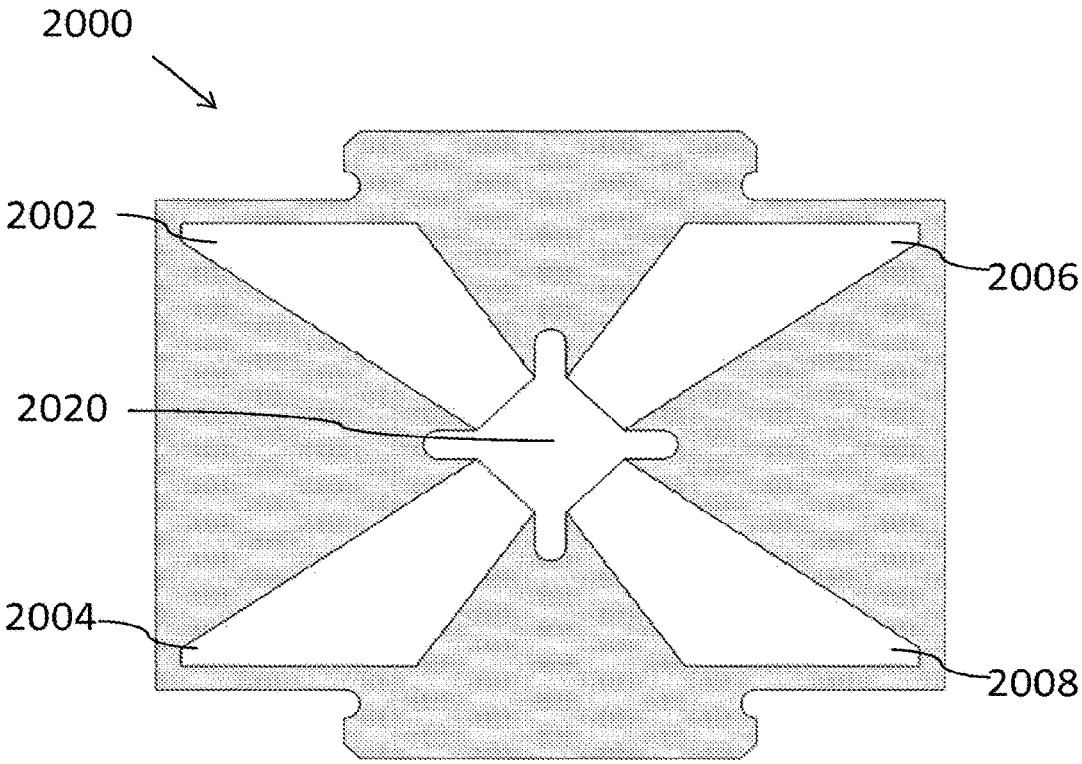
FIGS. 20A and 20B are illustrations of lenses with orifices smaller than an orifice formed by a segment of the collision cell, in accordance with certain examples.
Figure 20B:
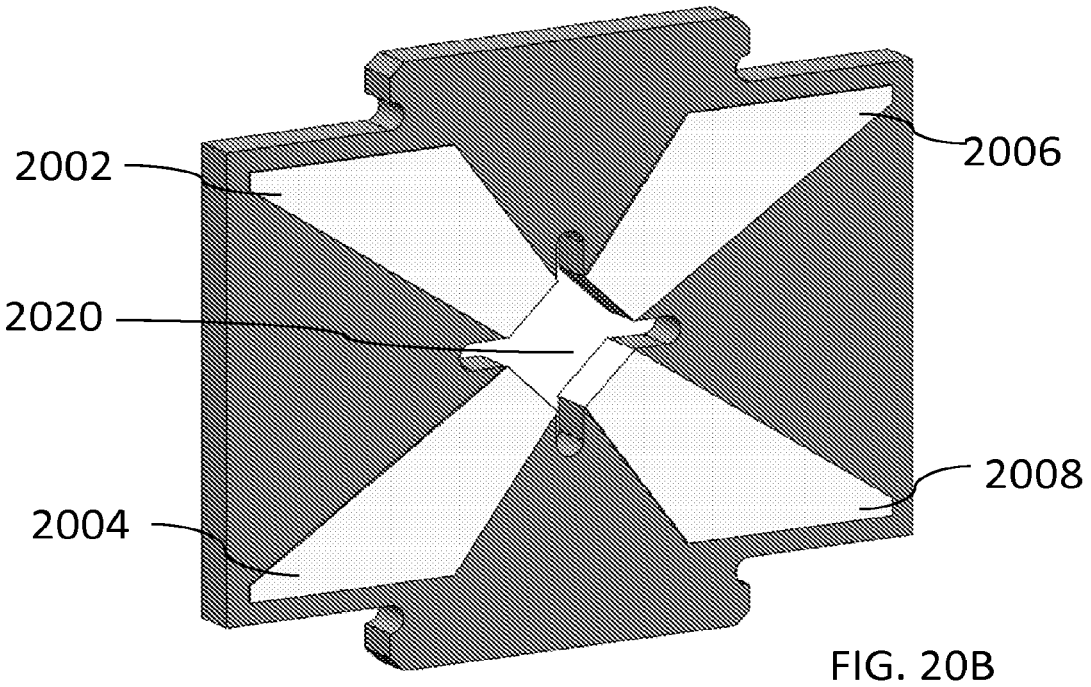
Figure 21:
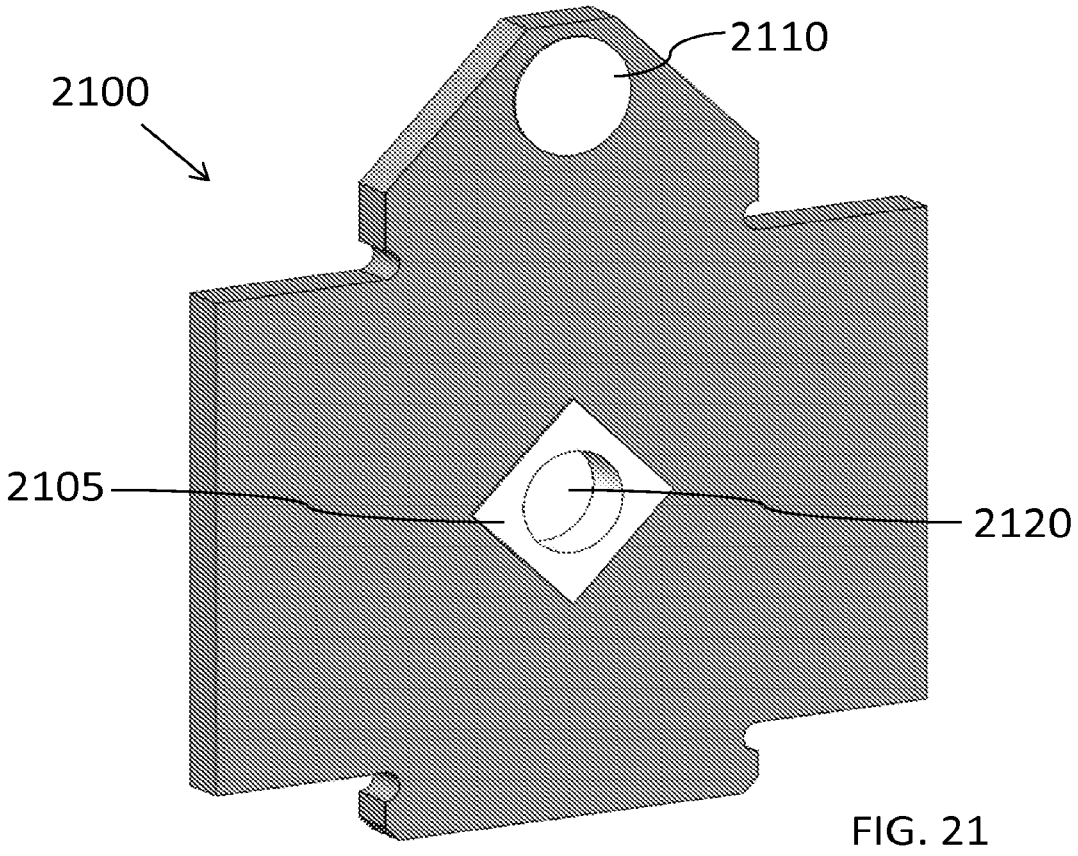
FIG. 21 is an illustration of a lens with a different cross-sectional shape than the lens of FIGS. 20A and 20B, in accordance with certain examples.

In certain examples, the overall size of the apertures of the lenses described herein may vary. In some examples, each lens present in the collision cell may have the same cross-sectional shape and size, whereas in other instances different lenses may have different cross-sectional shapes and/or sizes. Referring to FIGS. 20A and 20B, a lens 2000 is shown that is suitable for insertion between segments of a section of the collision cell. The lens 2000 comprises areas 2002,

2004, 2006 and 2008 that may couple to the poles to permit the RF field to continue at the pole/lens interface. For example, in certain instances a respective area couples to one of the poles of the RF rod assembly to permit the RF field to continue through the lens 2000. The overall cross-sectional size of an aperture 2020 can be less than or greater than respective segments to which the lens areas couple to, as described in more detail below. In some instances, the size of the aperture 2020 can be less than the size of an apertures formed by the poles to limit the flow or conductance through the cell. In other instances, the size of the aperture 2020 can be greater than the size of the apertures formed by the poles so the lens does not limit the flow or conductance through the cell. In some embodiments, the lens 2000 may take the form of a layered printed circuit board (PCB), e.g., a 2-layer printed circuit board, with conductive areas 2002, 2004, 2006 and 2008 that may couple to the poles of other segments of the collision cell. In some embodiments, the areas 2002, 2004, 2006 and 2008 may be in direct contact with the poles, whereas in other examples, one or more spring contacts (or other contacts) may be present that connect a particular region to an adjacent rod to electrically couple the rod to the conductive area of the lens 2000. The conductive areas 2002, 2004, 2006 and 2008 may be present on each surface of the lens 2000, so the lens 2000 can electrically couple to different rod segments of the segmented quadrupole. For example, a first quadrupole segment may abut one conductive area on one surface of the lens 2000 and an adjacent quadrupole segment may abut one conductive area on the opposite, other surface of the lens 2000. The RF voltages (and/or DC voltages if desired) may be provided from one segment of the quadrupole through the lens 2000 and on to another segment of the quadrupole. The presence of the conductive elements 2002-2008 permits the RF field to continue through the lens 2000 without any substantial interruption or distortion. If desired, the orifice 2020 may be split into two or more orifices to provide for additional control of gas and/or ion flow through the collision cell.

Where the lens 2020 comprises an aperture or orifice with a different size than the aperture or orifice formed by the poles, other lenses in the system may also have a different size. Referring to FIG. 21, the lens 2100 may include a centrally located conductive element, e.g., a central conductor 2105 that can couple to, and be floated against, the quadrupole rods of the collision cell. In some embodiments, the surfaces may be present on only an inner surface of the lens 2100. In the lens 2100, there may be a conductive element 2110 is present which may be used to bring out the connection to inter-stage lenses. For example, the lenses can be floated against the RF poles. In some instances, the element 2110 may be electrically coupled to the element 2105 by configuring the lens 2100 to be a multi-layered PCB, e.g., a 4-layered PCB, where the middle layers of the PCB are electrically coupled to each other. An orifice 2120 is present in the lens 2100. The orifice 2100 may have a cross-section similar to the orifice 2020 of the lens 2000 or may have a different cross-section. As shown in FIG. 21, the orifice 2120 is generally circular shapes, whereas the orifice 2020 in lens 200 is generally square-shaped, e.g., square shaped with dimensions of 4-6 mm, for example. In some embodiments, the lens 2100 may be used to push or pull ions from the collision cell. Current can be provided to the element 2110 and on to the element 2105, and depending on the nature of the current, it can be used to push ions out of one segment of the collision cell (or push ions from one segment of the collision cell to another) or to draw ions into the collision cell, e.g., draw ions into an entrance of the collision cell or draw ions into one segment of the collision cell from another segment of the collision cell. In operation, an electrical contact may be placed against the element 2110 to provide current to the element 2105. If desired, the electrical contact may be configured similar to the spring contact pins described herein.

Figure 22A:
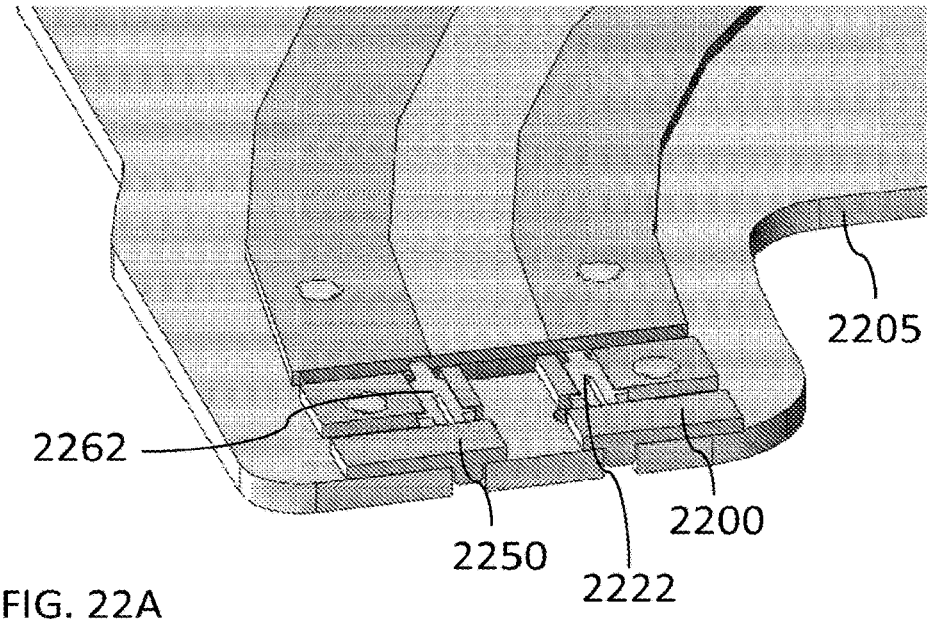
FIGS. 22A and 22B are illustrations of an entrance segment and lens, in accordance with certain examples.
Figure 22B:
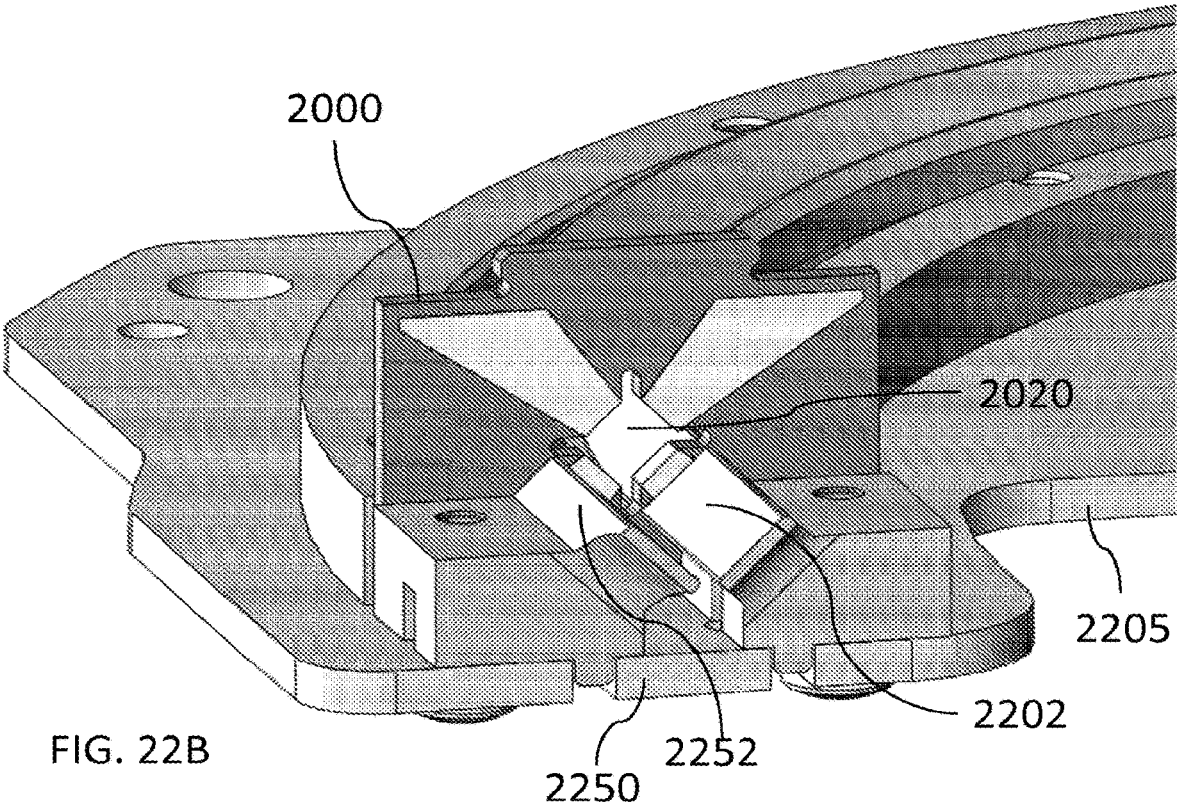

In some instances, the lens 2000 can be used at an entrance of the collision cell. For example, FIGS. 22A and 22B show the lens 2000 being present at an entrance end of a collision cell. While not shown, a top plate of the collision cell generally mirrors a bottom plate 2205 and couples to the bottom plate 2205 in a suitable manner to generally seal the fluid path within the collision cell. An entrance segment 2000 may be present in the collision cell. The entrance segment can comprise conductive elements 2200, 2250 that are configured to contact a conductive element of the lens 2000 through surfaces 2202, 2252, respectively. The presence of the segments 2200 and 2250 permits the RF field to be present at the terminal portion of the entrance section of the collision cell. Similar entrance segments would be present and coupled to the top support plate. The top plate segments would electrically couple to other conductive elements of the lens 2000 to permit a quadrupolar field to be provided and continue through the lens 2000 and on to other segments of the collision cell. As shown more particularly in FIG. 22B, the orifice 2020 can be sized and arranged to limit or control gas or ion flow into the cell. In this configuration, the overall size of the orifice 2020 is less than the path or orifice formed by the various entrance segments including entrance segments 2200, 2250 and the corresponding top plate entrance segments. For example, the top of the surface 2202 resides below the orifice 2020 such that some portion of the lens face is open to the aperture formed by the entrance segments. In some instances, the orifice 2020 may be about 4 mm by 4 mm and the orifice formed by the entrance segments is greater than 4 mm wide and greater than 4 mm long, e.g., is 5 mm by 5 mm or 6 mm by 6 mm.

Figure 23A:
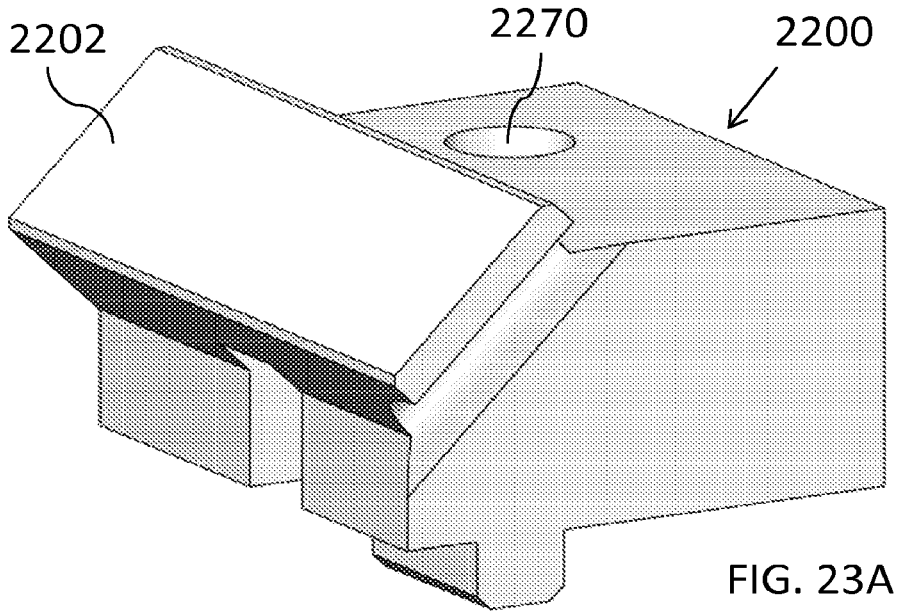
FIGS. 23A and 23B are illustrations of entrance segments, in accordance with certain examples.
Figure 23B:
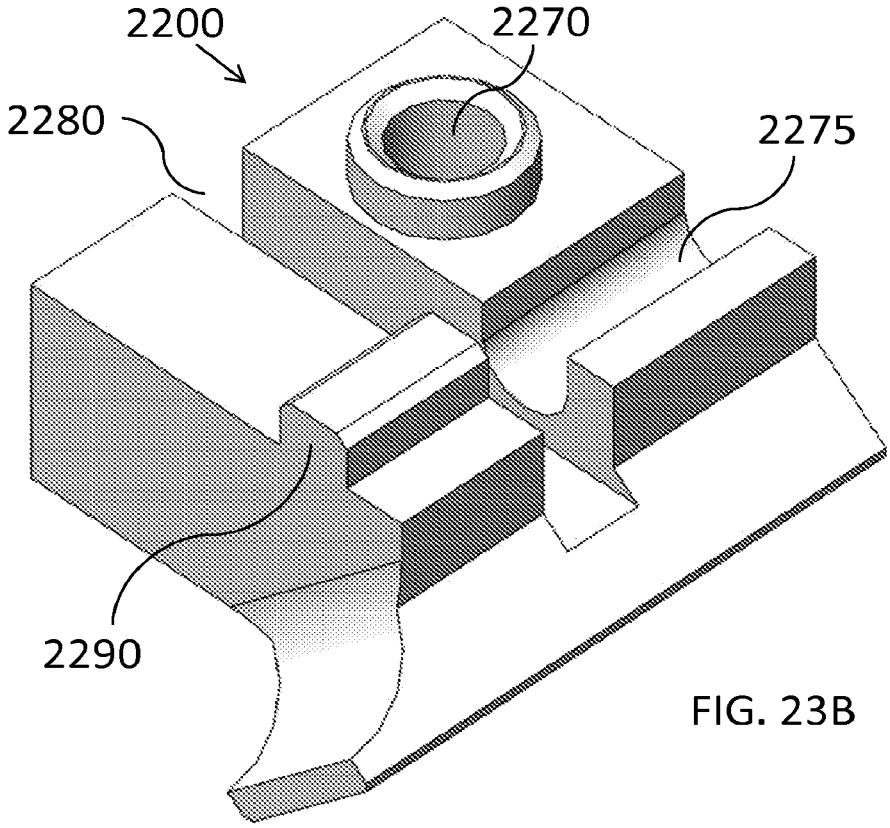

In certain examples, the segment 2200 comprises a conductive element or face 2202 that can couple to a pole of the quadrupole, an aperture 2270 that may comprise threads to receive a screw or bolt to couple the segment 2200 to the bottom plate (or top plate as the case may be), a groove 2275 and alignment features 2280 and 2290 to facilitate proper placement of the segment 2200 on one of the top or bottom plates. In the configuration shown in FIGS. 23A and 23B, a slot 2280 and a boss 2290 are each present to permit coupling of the segment 2200 to a plate in a single orientation. The groove 2275 can be sized and arranged to receive a coupler to couple the segment 2200 to the lens 2000 and to the other segments of the collision cell. In some embodiments, the groove 2280 may be sized and arranged to receive a pin contact that can be biased against the lens and/or other segments of the cell to hold the entrance segment in place. The upper surface of the element 2202 can reside below an aperture 2020 of the lens 2000 as shown in FIG. 22B. If desired, however, the segment 2200 can be sized and arranged such that the surface of the element 2202 is above the aperture 2020 of the lens 2000.

Figure 24:
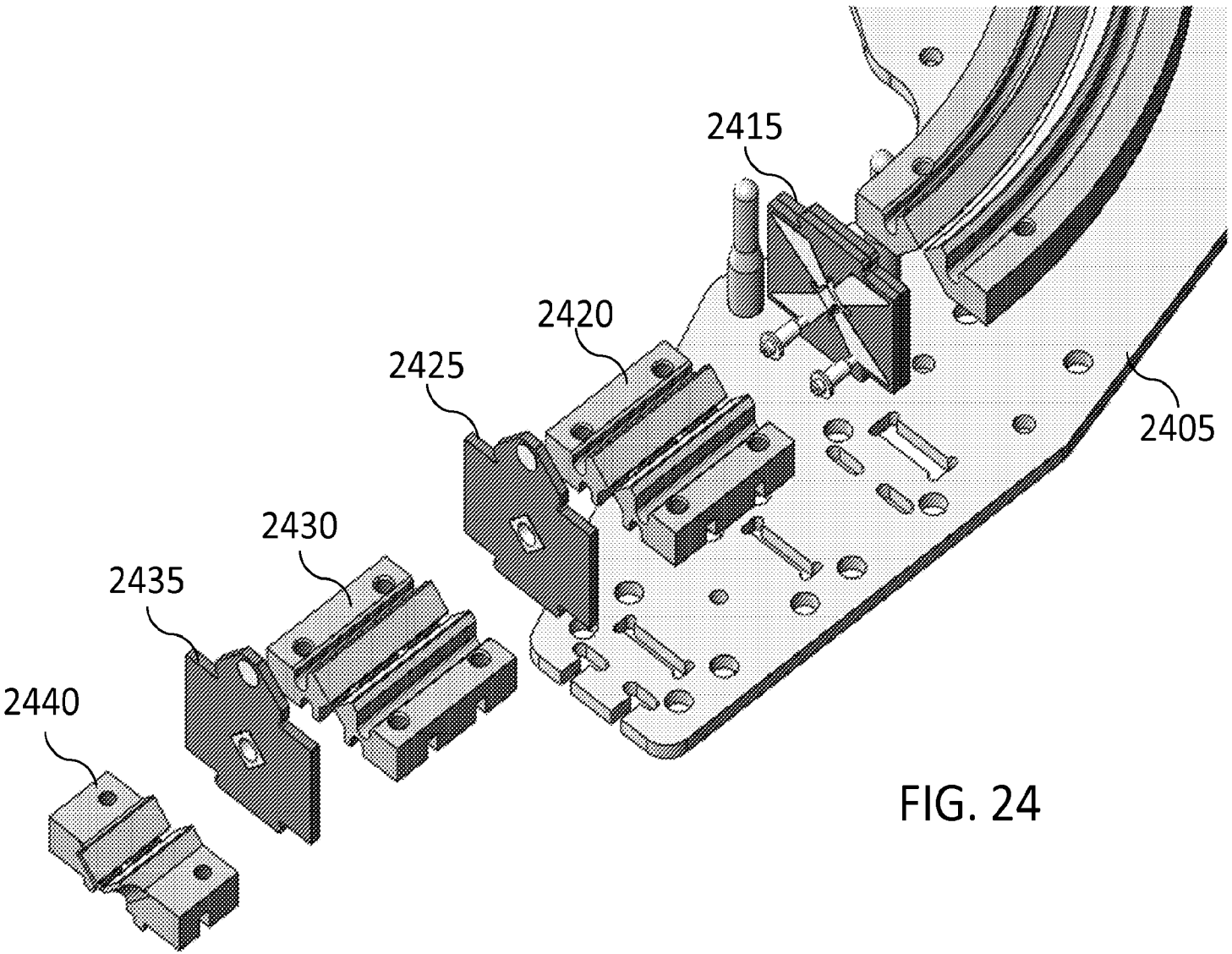
FIG. 24 is an illustration showing an exploded view of various components at an exit end of a collision cell, in accordance with certain examples.

Referring now to FIG. 24, an exploded view of an exit section of the collision cell is shown. The collision cell comprises a bottom plate 2405 that is sized and arranged to receive various components that can couple to the bottom plate 2405. For example, the bottom plate 2405 may comprise openings, grooves, slots, etc. that may be configured to receive the components of the collision cell and couple to the components through one or more fasteners or other attachment methods. In some embodiments, one or more fasteners may be inserted into the bottom plate 2405 from the bottom and through one or more components that are configured to couple to the bottom plate 2405 to retain the component to the bottom plate 2405. In some examples, the fastener may be a screw or bolt that can couple to an opening or aperture, e.g., one with threads, of the component to assemble the component to the bottom plate 2405. In the particular configuration shown in FIG. 24, the exit section or downstream stage may comprise lenses 2415, 2425 and 2435 with exit segments 2420 and 2430 between the lenses 2425 and 2435 and exit segment 2440 at the exit end of the collision cell. Ions which are selected by the collision region with a particular mass-to-charge ratio are received by the downstream region where they may be cooled, e.g., decelerated, prior to exiting the collision cell. The lens 2415 may be, for example, similar to the lens 2000, e.g., may be a lens comprising a 2-layer PCB. The orifice of the lens 2415 may be smaller than the orifice formed by the various exit segments 920, 930, and 940 (when they are coupled to corresponding upper exit segments) or the orifice may be larger, if desired. The potential of the lens 2015 may be selected such that ions which pass through the lens generally do not flow back into the collision cell. Ions may then enter into the regions formed by components 2420-2440 where, for example, they can be pushed out of the collision cell by the lenses 2425 and 2435.

Figure 25:
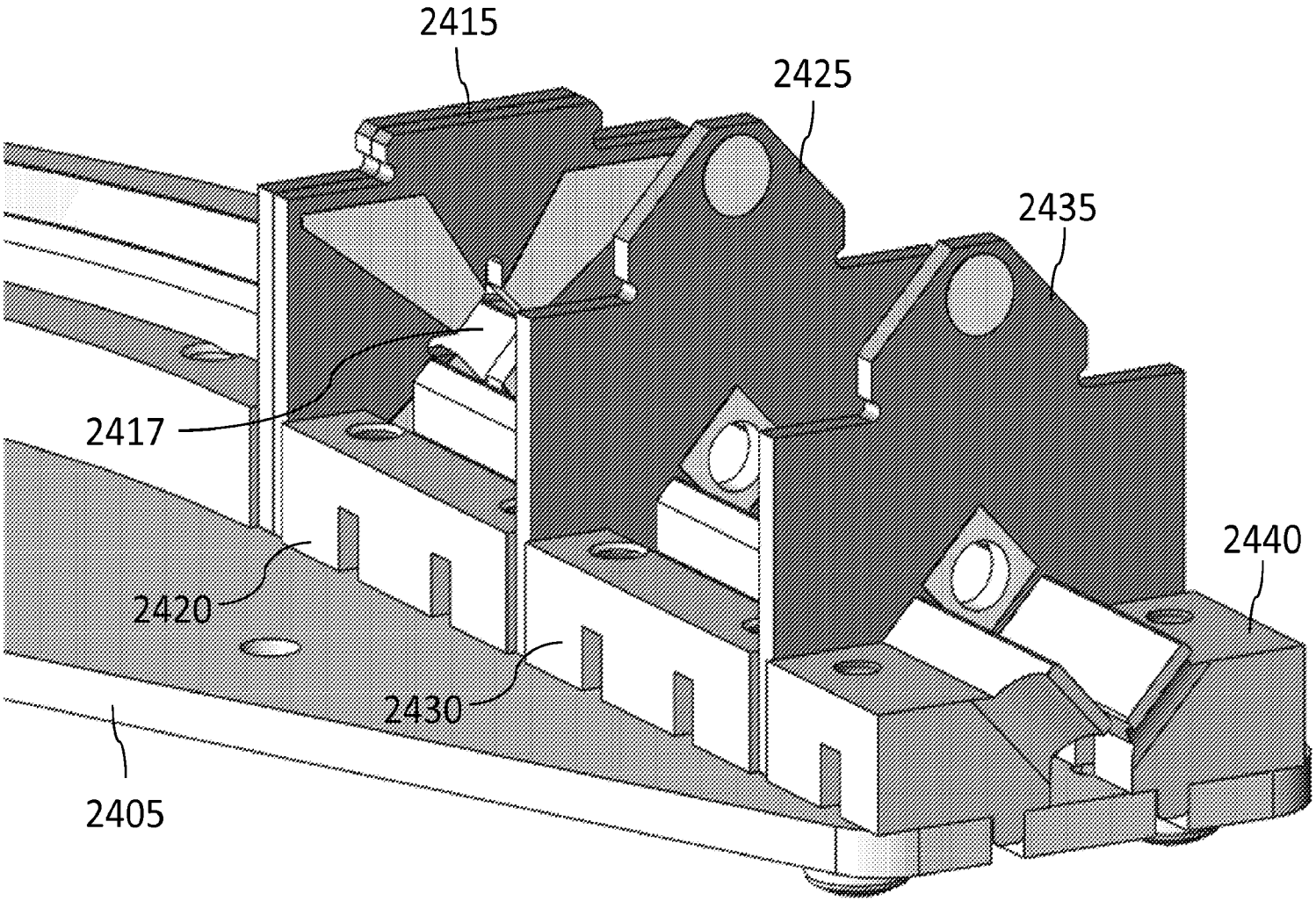
FIG. 25 is an illustration showing an assembled view of the components shown in FIG. 24, in accordance with certain examples.

In certain embodiments and referring to FIG. 25, another view of the exit section is shown. To cool the ions, the cooling section comprises a plurality of segments 2430, 2440 that can be used to decelerate the entering ions and/or push the ions out of the collision cell. As shown in the configuration of FIG. 25, the conductive inner portions of the lenses 2425 and 2435 generally do not contact the exit segments 2430, 2440. In addition, the orifices of lenses 2425 and 2435 are round, whereas the orifice of the lens 2415 is square. The orifice 2417 of the lens 2415 is also smaller than the aperture or space formed by the segment 2420 and its corresponding segment in a top plate. As ions enter into the region between the lenses 2425 and 2435, they are decelerated and can be pushed out of the collision cell toward the segment 2440 by the potential on the lenses 2425 and 2435. If desired, the lens 2435 can be configured to pull ions toward it while the lens 2425 is configured to push ions away from it toward the lens 2435. In some instances, the potential on the lenses 2425 and 2435 may be controlled such that one lens is on and one lens is off. In other instances, the potential may be reversed such that a lens can push or pull ions depending on the exact applied potential. For example, the lens 2435 may be configured to pull ions in one configuration and then configured to push ions in another configuration. By selecting the potentials applied to the lenses, the ions can be forced to exit the exit section in a desired manner and at a desired time.

Figure 26:
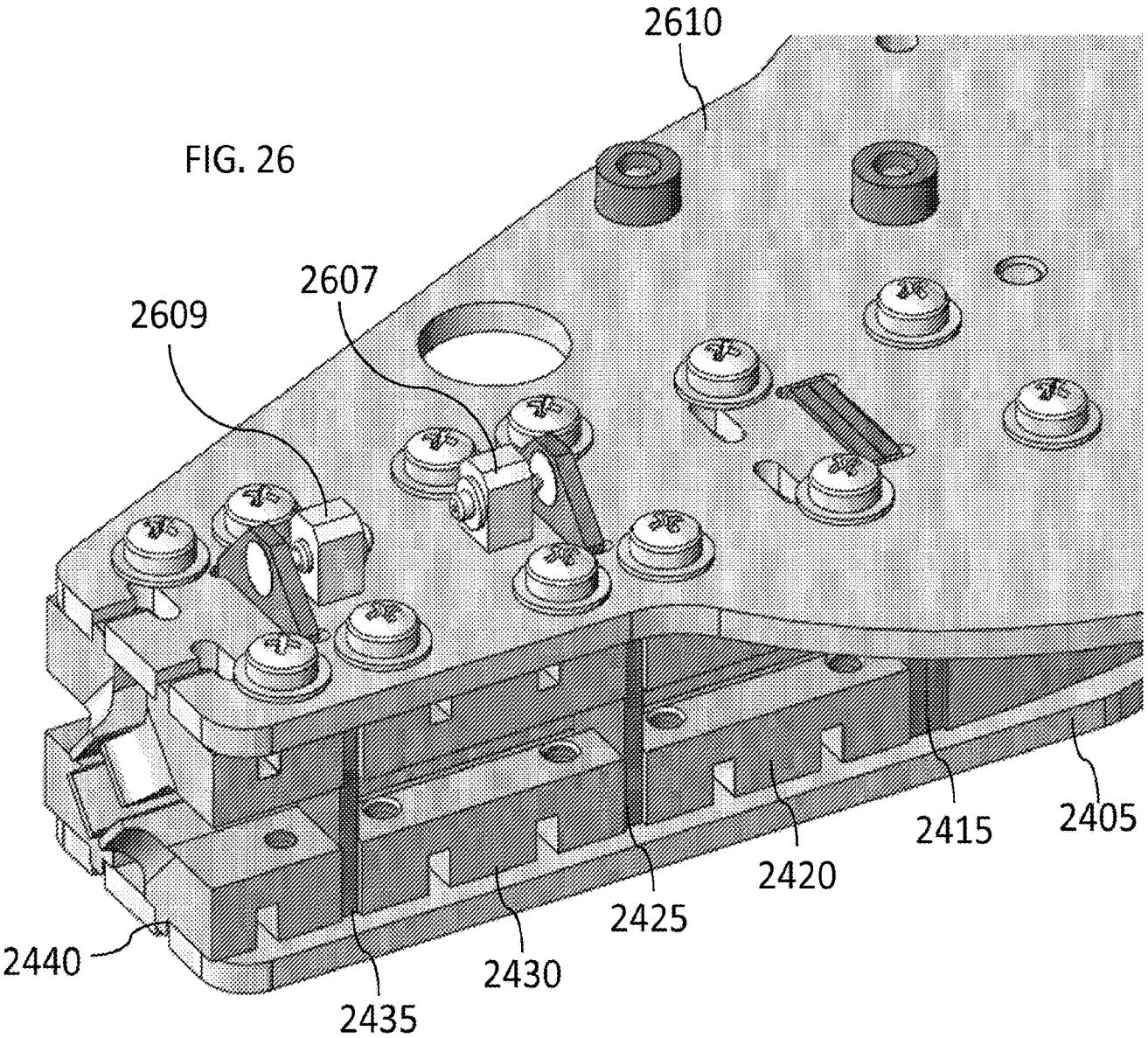
FIG. 26 is an illustration showing the bottom and top plates of the collision cell coupled to each other, in accordance with certain examples.
Figure 27:
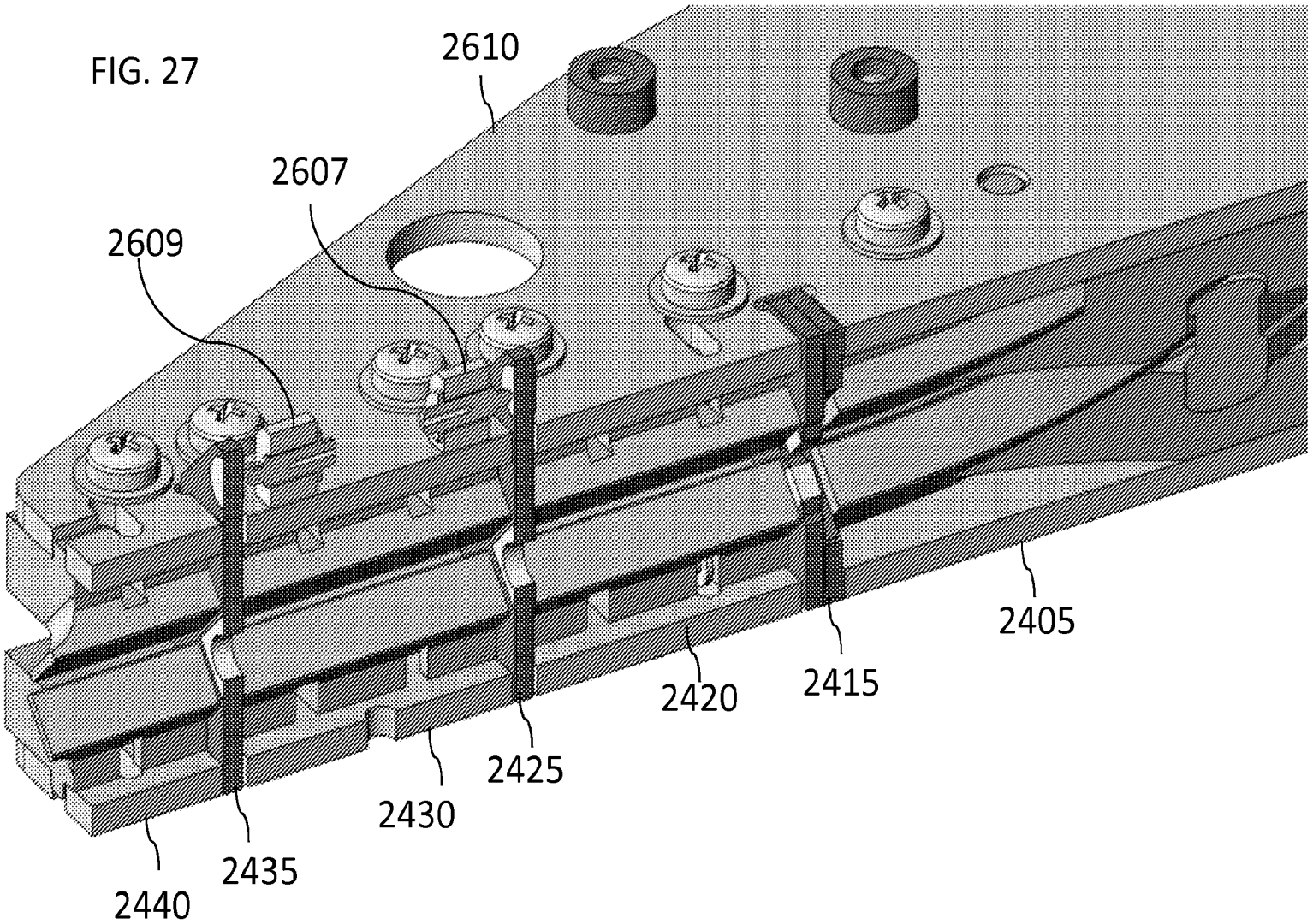
FIG. 27 is cross-section of the illustration of FIG. 26, in accordance with certain examples.

In some embodiments, the potential may be applied to the lenses 2425 and 2435 by coupling the lenses 2425, 2435 to one or more power sources through connectors on the upper surfaces of the lenses 2425, 2435. For example and referring to FIG. 26, a spring contact 2607 on a top plate 2605 is present that is configured to electrically couple a power source (not shown) to the lens 2425. Similarly, a spring contact 2609 is present on the top plate 2605 that couples the lens 2435 to a power source. In the cut away view shown in FIG. 27, the spring contacts 2607, 2609 sit on the top plate 2605. An electrical connection can be provided between the spring contact posts to provide current from a power source to the lenses 2425, 2435. In some embodiments, different currents or potentials may be provided to each of the lenses 2425, 2435. In certain configurations, the potential on each lens 2425, 2435 may be independently controlled using a controller, microprocessor or other components of the instrument. In other instances, it may be desirable to couple the spring contacts 2607, 2609 to one or more of the RF rods in the collision cell. In such configurations, a through hole in the top plate 2605 may exist to permit electrical coupling of the spring contacts 2607, 2609 with one or more RF rods of the collision cell. The post of the spring contacts 2607, 2609 may include suitable components to alter the potential or current, e.g., resistors, circuitry, etc., received from the RF rods to provide a suitable electric field or electric potential to push or pull the ions in a desired direction. It will be within the ability of the person of ordinary skill in the art, given the benefit of this disclosure, to configure the lenses 2425, 2435 in a suitable manner to push and pull ions.

Figure 28:
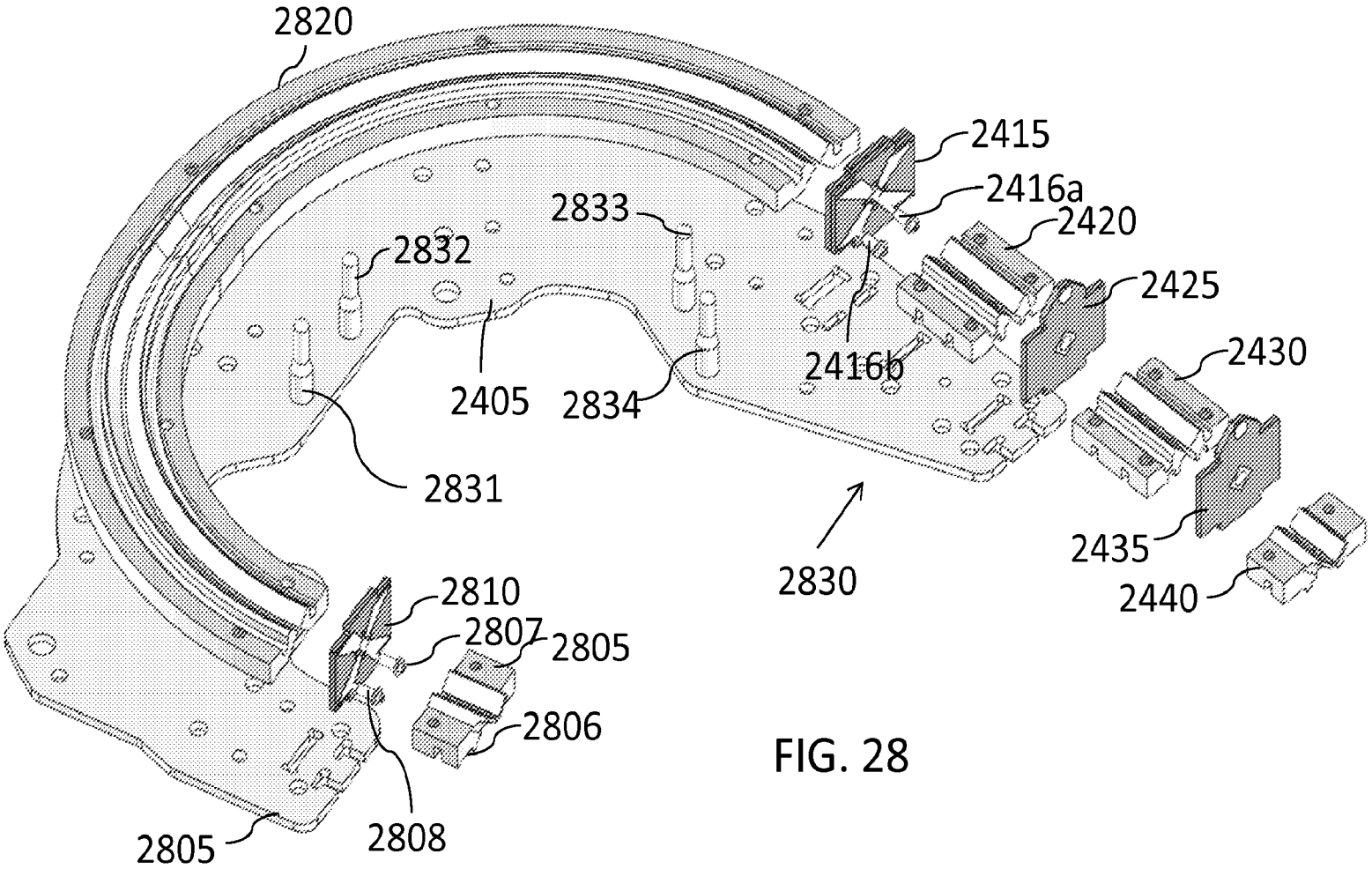
FIG. 28 is an illustration of a collision cell comprising an entrance section, a collision section and a cooling section, in accordance with certain examples.
Figure 29:
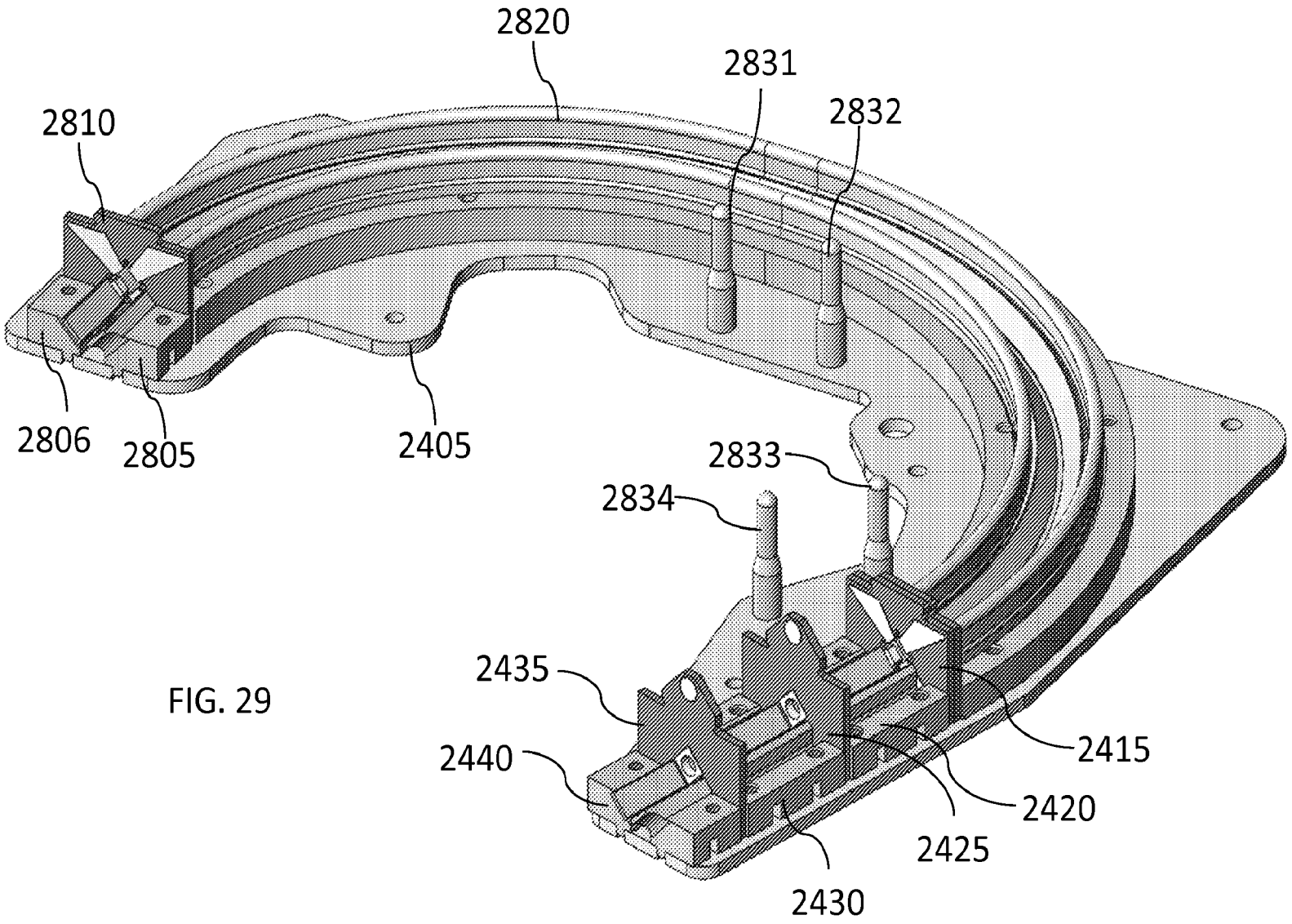
FIG. 29 is an illustration showing an assembled view of the components shown in FIG. 28, in accordance with certain examples.

In certain configurations, a collision cell may comprise a top plate and a bottom plate that comprises an entrance section with a lens, a collision section coupled to the entrance section and an exit section comprising at least one lens and coupled to the collision section. One example of the bottom plate is shown in FIGS. 28 and 29. While not shown in FIG. 28, the top plate would generally be a mirror image that would include suitable components to couple to the components of the bottom plate. The bottom plate 2405 comprises an entrance section 2805, a collision section 2820 and an exit section 2830. The entrance section 2805 comprises entrance segment blocks 2805, 2806 and a lens 2810. The entrance segments 2805, 2806 are coupled to the lens 2810 through pogo pins 2807, 2808, respectively. The lens 2810 is operative as a gas restrictor while permitting the RF fields to remain intact. In some instances, the orifice of the lens 2810 may be greater than, less than or equal to the orifice size formed by the entrance segments. In some instances, the orifice of the lens is about 4 mm by 4 mm, whereas the orifice formed by the entrance segments are greater than 4 mm by 4 mm, e.g., 5 mm by 5 mm or 6 mm by 6 mm. The collision section 2820 is configured as a curved quadrupole and curves through about 180 degrees from the beginning of the collision section 2820 to the end of the collision section 2820. FIG. 29 shows two of the curved rods 2821, 2822 of the quadrupole. Similar curved poles are positioned underneath the poles 2821, 2822 to provide four rods arranged in a generally square arrangement similar to that shown in FIG. 4. The bottom plate 2405 comprises guide rods 2831-2834 coupled to the bottom plate 2405 to assist in coupling and alignment of the top plate (not shown) to the bottom plate. The exit section 2830 of the collision cell comprises two lenses (collectively element 2415) sandwiched together. The lenses 2415 are coupled to an exit segment 2425 through pogo pins 2416*a*, 2416*b*. Another lens 2425 is coupled to the segment 2430 and to the exit segment 2420. The segment 2430 is coupled to a fourth lens 2435, which is coupled to an exit segment 2440. The exact configuration of the lenses 2415, 2425 and 2445 may vary, but in certain instances the lenses 2415 are effective to couple to the quadrupolar rods, and the lenses 2425, 2435 can be configured to push and/or pull ions through the exit segments 2430 and 2440. If desired, the orifice size of the lens 2415 may be the same as the orifice size of the lens 2810 or may be greater than or less than the orifice size of the lens 2810.

Figure 30:
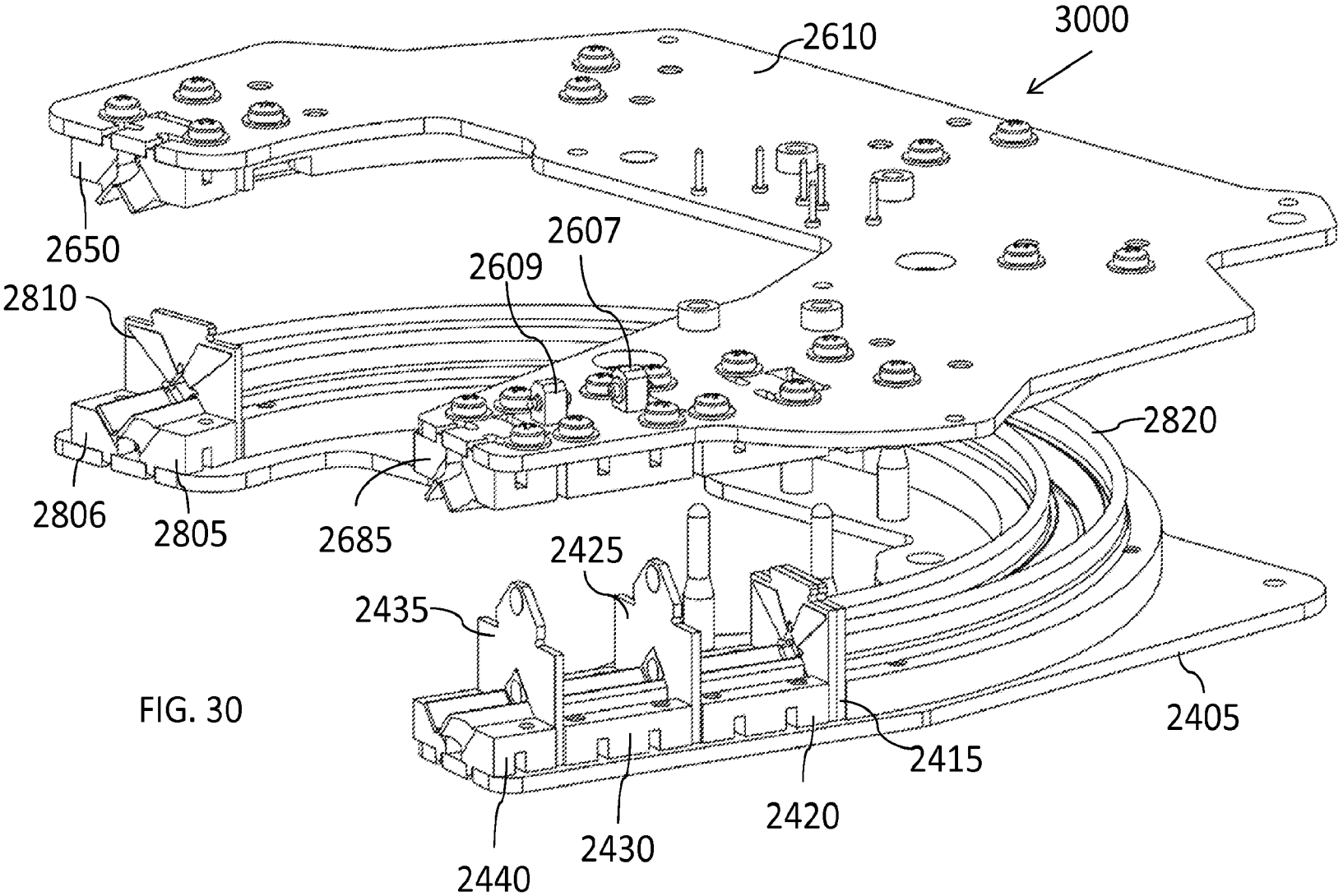
FIG. 30 is an illustration of an assembled collision cell, in accordance with certain examples.

In certain examples and referring to FIG. 30, a collision cell 3000 comprises a bottom plate 2405 and a top plate 2610. The bottom plate 2405 comprises entrance segments 2805, 2806 coupled to a first lens 2815. A corresponding entrance segment 2650 on the top plate 2610 is shown for illustration purposes. The bottom plate 2405 shows a collision section 2820 coupled to an exit section which comprises lenses 2415, 2425 and 2435 coupled to intervening exit segments 2420, 2430 and 2440, respectively. For reference, a corresponding exit segment 2685 is shown on the top plate 2610. The top plate 2610 and the bottom plate 2405 couple to each other through a friction fit and may include gaskets, outer seals or other components to provide a generally fluid tight seal to permit vacuum operation of the collision cell 3000. If desired, one or more fasteners can be used to couple the top plate 2610 and the bottom plate 2405 to each other.

Figure 31:
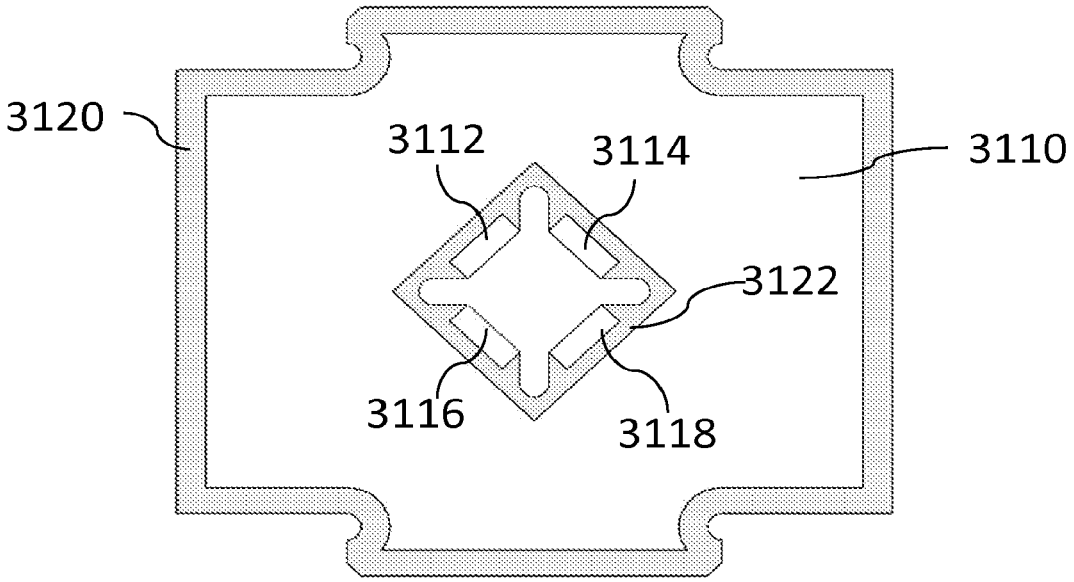
FIGS. 31 and 32 are illustrations of lenses, in accordance with certain examples.
Figure 32:
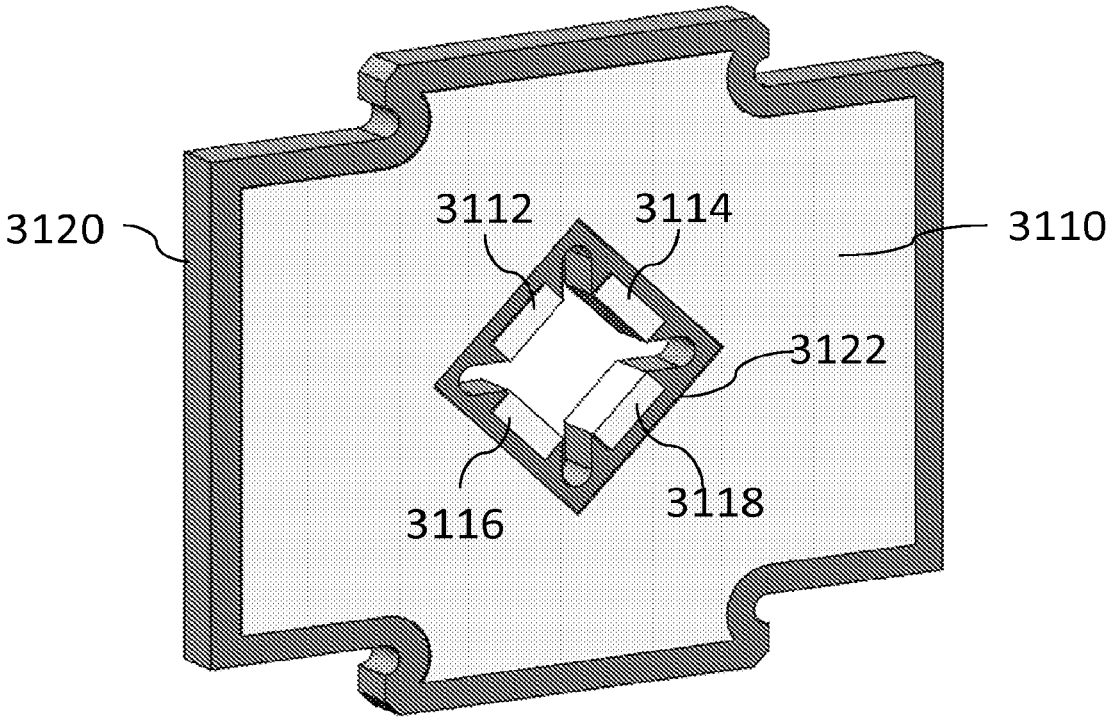

In certain configurations, the lenses described herein can be configured with different areas or regions that are conductive and non-conductive. For example and referring to FIGS. 31 and 32, a lens is shown comprising a conductive region 3110, a non-conductive regions 3120, conductive inner regions 3112-3118 and a non-conductive region 3122 separating the conductive inner regions 3112-3118 and the conductive region 3110. In some instances, the inner conductive regions 3112-3118 may be electrically coupled to the conductive region 3110 through inner coupling or connections such that current can be provided from the conductive region 3110 to the inner conductive regions 3112-3118, e.g., so the field from any quadrupole may be continuous through the lens. For example, the lens of FIGS. 31 and 32 may take the form of a layered printed circuit board (PCB), e.g., a 2-layer printed circuit board, with conductive areas 3112-3118 that may couple to the poles of other segments of the collision cell and/or to the conductive region 3110.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A method of ionizing a sample comprising introducing the sample into an ion collision cell to ionize the sample, wherein the ion collision cell is fluidically coupled to an ion source at an entrance section of the ion collision cell and is fluidically coupled to an ion detector at an exit section of the ion collision cell, the ion collision cell comprising a sectioned quadrature rod assembly configured to provide a collision section between the entrance section and the exit section, the sectioned quadrature rod assembly comprising first, second, third, and fourth pole segments in the sectioned quadrature rod assembly, and a lens between the entrance section and the exit section, wherein the lens is coupled to and in contact with two adjacent sections of the sectioned quadrature assembly, and wherein the lens comprises an aperture and a plurality of separate conductive elements disposed on each side of the lens, in which a respective disposed conductive element on at least one side of the lens is configured to electrically couple to one of the first, second, third, and fourth pole segments of the sectioned quadrature rod assembly to permit an RF field to continue at a pole/lens interface in the ion collision cell.

2. The method of claim 1, further comprising introducing a collision gas into the ion collision cell through a gas port is fluidically coupled to the entrance section.

3. The method of claim 1, wherein at least one of the first, second, third and fourth pole segments is curved.

4. The method of claim 1, wherein the sectioned quadrature rod assembly is curved through about 180 degrees when the entrance section, the exit section and the collision section are coupled to each other.

5. The method of claim 1, wherein the separate conductive elements disposed on the lens are components of a printed circuit board.

6. The method of claim 5, wherein the printed circuit board is a 2-layer printed circuit board.

7. The method of claim 1, wherein the lens is sized and arranged to restrict gas flow through the ion collision cell, and wherein the first and second poles segments are positioned in a top support plate and the third and fourth pole segments are positioned in a bottom plate, wherein coupling of the top support plate to the bottom support plate provides a fluid tight seal between the top support plate and the bottom support plate and provides an opening, formed from the coupled top and bottom support plates, where ions may travel through.

8. The method of claim 1, wherein the lens is positioned between segments of the entrance section and the collision section.

9. The method of claim 1, further comprising introducing a cooling gas through a gas port fluidically coupled to the exit section.

10. The method of claim 1, further comprising an additional lens between the entrance section and the exit section of the sectioned quadrature rod assembly, the additional lens comprising an aperture and a plurality of separate conductive elements disposed on each side of the additional lens, in which a respective disposed conductive element on each side of the additional lens.

11. The method of claim 10, wherein the additional lens is positioned between the collision and the exit section of the ion collision cell.

12. The method of claim 11, further comprising a third lens in the exit section, in which the third lens comprises a central conductive element and a terminal connector electrically coupled to the central conductive element through a body of the third lens.

13. The method of claim 12, wherein the third lens is positioned downstream from the additional lens.

14. The method of claim 13, further comprising a fourth lens in the exit section, in which the fourth lens comprises a central conductive element and a terminal connector electrically coupled to the central conductive element through a body of the fourth lens.

15. The method of claim 14, in which the fourth lens is positioned downstream from the third lens.

16. The method of claim 15, further comprising a first exit segment positioned between the additional lens and the third lens, a second exit segment positioned between the third lens and the fourth lens and a third exit segment coupled to the fourth lens.

17. The method of claim 16, wherein at least one of the first exit segment the second exit segment and the third exit segment is configured to receive a cooling gas.

18. The method of claim 17, wherein the third lens and the fourth lens are configured to push or pull ions through the collision cell.

19. The method of claim 18, wherein the third lens and the fourth lens are electrically coupled to a power source.

20. The method of claim 19, wherein the third lens and the fourth lens each comprises a 4-layered printed circuit board.

* * * * *